US010249974B2

(12) United States Patent
Copper et al.

(10) Patent No.: US 10,249,974 B2
(45) Date of Patent: Apr. 2, 2019

(54) ELECTRICAL POWER CONNECTOR

(71) Applicant: FCI USA LLC, Etters, PA (US)

(72) Inventors: Charles Copper, Hummelstown, PA (US); Nazareth Eppley, Camp Hill, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/853,184

(22) Filed: Dec. 22, 2017

(65) Prior Publication Data

US 2018/0183172 A1 Jun. 28, 2018

Related U.S. Application Data

(63) Continuation of application No. 15/039,233, filed as application No. PCT/US2014/067298 on Nov. 25, 2014, now Pat. No. 9,853,388.

(Continued)

(51) Int. Cl.

| | |
|---|---|
| ***H01R 13/44*** | (2006.01) |
| ***H01R 13/648*** | (2006.01) |
| ***H01R 13/04*** | (2006.01) |
| ***H01R 13/11*** | (2006.01) |
| ***H01R 13/53*** | (2006.01) |

(Continued)

(52) U.S. Cl.

CPC ..... *H01R 13/44* (2013.01); *H01R 12/724* (2013.01); *H01R 12/732* (2013.01); *H01R 12/737* (2013.01); *H01R 13/04* (2013.01); *H01R 13/11* (2013.01); *H01R 13/112* (2013.01);

(Continued)

(58) Field of Classification Search

CPC ..... H01R 23/27; H01R 24/84

See application file for complete search history.

(56) References Cited

U.S. PATENT DOCUMENTS

| | | | |
|---|---|---|---|
| 2,384,267 | A | 9/1945 | Andersen |
| 3,011,143 | A | 11/1961 | Dean |

(Continued)

FOREIGN PATENT DOCUMENTS

| | | | |
|---|---|---|---|
| CN | 1047475 | C | 12/1999 |
| CN | 101174747 | A | 5/2008 |

(Continued)

OTHER PUBLICATIONS

International Search Report and Written Opinion for International Application No. PCT/US2014/067298 dated Feb. 27, 2015.

(Continued)

*Primary Examiner* — Ross N Gushi

(74) *Attorney, Agent, or Firm* — Wolf, Greenfield & Sacks, P.C.

(57) ABSTRACT

An electrical power connector can include an electrically insulative connector housing, a first plurality of electrical contacts supported by the connector housing, and a second plurality of electrical contacts supported by the connector housing. The first plurality of electrical contacts can be of a first type, and the second plurality of electrical contacts are of a second type and positioned adjacent to the first plurality of electrical contacts. The arrangement of the electrical contact can provide creepage protection for the electrical connector. Further, the electrical contacts can include mating portions that are touch proof.

20 Claims, 11 Drawing Sheets

Related U.S. Application Data

(60) Provisional application No. 61/909,726, filed on Nov. 27, 2013.

(51) Int. Cl.
*H01R 24/84* (2011.01)
*H01R 12/72* (2011.01)
*H01R 12/73* (2011.01)

(52) U.S. Cl.
CPC ..... *H01R 13/113* (2013.01); *H01R 13/53* (2013.01); *H01R 13/648* (2013.01); *H01R 24/84* (2013.01)

(56) References Cited

U.S. PATENT DOCUMENTS 3,337,836 A 8/1967 Churla, Jr.
3,676,833 A 7/1972 Johnson
3,688,243 A 8/1972 Yamada et al.
3,827,007 A * 7/1974 Fairbairn ..... H01R 13/28 439/293
3,840,839 A 10/1974 Smaczny et al.
4,083,617 A 4/1978 Wyatt
4,392,703 A 7/1983 Hall et al.
4,455,056 A 6/1984 Herrmann, Jr. et al.
H113 H 8/1986 McNeel
4,720,267 A 1/1988 De Jong
4,818,237 A 4/1989 Weber
4,963,102 A 10/1990 Gettig et al.
4,990,099 A 2/1991 Marin et al.
5,120,268 A 6/1992 Gerrans
5,161,985 A 11/1992 Ramsey
5,306,171 A 4/1994 Marshall
5,308,258 A 5/1994 Hatsios
5,487,677 A 1/1996 Hoffner
5,498,167 A 3/1996 Seto et al.
5,595,497 A 1/1997 Wood
5,890,922 A 4/1999 Buchter et al.
6,022,227 A 2/2000 Huang
6,165,013 A 12/2000 Broussard
6,183,270 B1 2/2001 Huang et al.
6,190,192 B1 2/2001 White et al.
6,319,075 B1 11/2001 Clark et al.
6,350,134 B1 2/2002 Fogg et al.
6,364,718 B1 4/2002 Polgar et al.
6,383,032 B1 5/2002 Gerberding
6,447,307 B1 9/2002 Wu
6,475,032 B1 11/2002 Dvorak
6,790,067 B2 9/2004 Douty et al.
6,802,746 B2 10/2004 Carranza
6,824,412 B2 11/2004 Clement
6,935,870 B2 8/2005 Kato et al.
6,994,595 B2 2/2006 Baker et al.
7,004,795 B2 2/2006 Mancini et al.
7,077,668 B2 7/2006 Lapidot et al.
7,090,540 B2 8/2006 Masumoto et al.
7,108,534 B2 9/2006 Fabian
7,153,152 B1 12/2006 Eby et al.
7,153,170 B1 12/2006 Fabian
7,168,963 B2 1/2007 Minich et al.
7,247,058 B2 7/2007 Reeser et al.
7,270,570 B1 9/2007 Hamner et al.
7,303,410 B2 12/2007 Saito
7,374,436 B2 5/2008 Schell et al.
7,425,145 B2 9/2008 Ngo
7,435,110 B2 10/2008 Xiao et al.
7,448,884 B2 11/2008 Kato et al.
7,458,839 B2 12/2008 Ngo et al.
7,473,136 B2 1/2009 Hu et al.
7,476,108 B2 1/2009 Swain et al.
7,674,118 B2 3/2010 He
7,690,937 B2 4/2010 Daily et al.
7,731,520 B1 6/2010 Daily et al.
7,753,718 B2 7/2010 Bethurum et al.
7,758,380 B2 7/2010 Wang et al.
7,762,840 B2 7/2010 Hamner et al.
7,946,893 B2 5/2011 Chen et al.
7,972,164 B2 7/2011 Bucher
7,976,317 B2 7/2011 Patel et al.
7,976,330 B2 7/2011 Lin
7,988,481 B2 8/2011 Bethurum et al.
8,033,840 B2 10/2011 Wang et al.
8,070,529 B2 12/2011 Xiong et al.
8,187,017 B2 5/2012 Daily et al.
8,251,758 B2 8/2012 Yoshida
8,262,395 B2 9/2012 Ke et al.
8,267,724 B2 9/2012 Dodds et al.
8,277,241 B2 10/2012 Horchler et al.
8,398,440 B2 3/2013 Dodds et al.
8,641,440 B2 2/2014 Hariharesan et al.
8,851,930 B2 10/2014 Peng
8,864,501 B2 10/2014 Lin et al.
8,870,581 B2 10/2014 Chang
8,894,451 B2 11/2014 Shiratori et al.
8,932,082 B2 1/2015 Yu et al.
9,004,954 B2 4/2015 Baldwin et al.
9,136,623 B2 9/2015 Hamada et al.
9,136,631 B2 9/2015 Naito
9,147,975 B2 9/2015 Shiratori et al.
9,153,887 B2 10/2015 Chen
9,209,568 B2 12/2015 Yu et al.
9,246,286 B2 1/2016 Stowers et al.
9,306,335 B2 4/2016 Fan et al.
9,312,650 B1 4/2016 Chen
9,401,558 B1 7/2016 Yu et al.
9,419,356 B2 8/2016 Copper et al.
9,450,343 B2 9/2016 Shiratori et al.
9,472,902 B2 10/2016 Kao et al.
9,490,589 B2 11/2016 Shiratori et al.
9,496,651 B2 11/2016 Jeong et al.
9,551,483 B1 1/2017 Mostoller et al.
9,853,388 B2 12/2017 Copper et al.
2002/0034889 A1 3/2002 Clark et al.
2005/0059296 A1 3/2005 Wang
2006/0166536 A1 7/2006 Northey et al.
2006/0194472 A1 8/2006 Minich et al.
2006/0286864 A1 12/2006 Bethurum et al.
2007/0099512 A1 5/2007 Sato
2007/0197088 A1 8/2007 Lindkamp et al.
2007/0293084 A1 12/2007 Ngo
2008/0214027 A1 9/2008 Schell et al.
2009/0042450 A1 2/2009 Zheng et al.
2010/0048056 A1 2/2010 Daily et al.
2010/0304581 A1 12/2010 Davis et al.
2012/0164892 A1 6/2012 Ke et al.
2012/0289071 A1 11/2012 Dodds et al.
2014/0194005 A1 7/2014 Little et al.
2014/0206241 A1 7/2014 Chen
2017/0170594 A1 6/2017 Copper et al.

FOREIGN PATENT DOCUMENTS

CN 101276981 A 10/2008
CN 101416357 A 4/2009
CN 101950864 A 1/2011
CN 102687344 A 9/2012
CN 103534878 A 1/2014
EP 1605550 A1 12/2005
WO WO 2012/158616 A2 11/2012

OTHER PUBLICATIONS

International Preliminary Report on Patentability for International Application No. PCT/US2014/067298 dated Jun. 9, 2016.

* cited by examiner

ELECTRICAL POWER CONNECTOR

RELATED APPLICATIONS

This Application is a continuation of and claims the benefit under 35 U.S.C. § 120 of U.S. application Ser. No. 15/039,233 entitled "ELECTRICAL POWER CONNECTOR" filed on May 25, 2016, which is the U.S. National Stage of International Patent Application Number PCT/US2014/067298, entitled "ELECTRICAL POWER CONNECTOR" filed Nov. 25, 2014, which claims priority under 35 U.S.C. § 119(e) to U.S. Provisional Application Ser. No. 61/909,726, entitled "ELECTRICAL POWER CONNECTOR" filed on Nov. 27, 2013. The entire contents of these applications are incorporated herein by reference in their entirety.

BACKGROUND

Connectors used to transmit electrical power, such as alternating current (AC) power and/or direct current (DC) power include power contacts mounted within an electrically-insulated housing.

SUMMARY

In accordance with one embodiment, an electrical power connector includes an electrically insulative connector housing, a first plurality of electrical contacts supported by the connector housing, and a second plurality of electrical contacts supported by the connector housing. The first plurality of electrical contacts is of a first type, and the second plurality of electrical contacts is of a second type and positioned adjacent to the first plurality of electrical contacts. Each of the first plurality of electrical contacts can extend along a respective length to a mating portion, and the housing can extend beyond the mating portions of the first plurality of electrical contacts such that each of the first plurality of electrical contacts is touch proof. Each of the second plurality of electrical contacts can extend along a respective length to a mating portion, and the housing can extend beyond the mating portions of the second plurality of electrical contacts such that each of the second plurality of electrical contacts is touch proof. In an example embodiment, the first plurality of electrical contacts is plug contacts, and the second plurality of electrical contacts is receptacle contacts.

In accordance with another embodiment, an electrical power connector includes a dielectric connector housing that includes a plurality of beams and a plurality of shrouds that each terminate at a respective distal end. The plurality of beams and the plurality of shrouds can define a mating interface that is configured to mate with a complementary electrical power connector along a mating direction. The electrical power connector can further include a first plurality of electrical contacts that is supported by the connector housing. The first plurality of electrical contacts can be spaced apart from each other along a lateral direction that is substantially perpendicular to the mating direction. The electrical power connector can further include a second plurality of electrical contacts that is supported by the connector housing. The second plurality of electrical contacts can be spaced apart from each other along the lateral direction. The second plurality of electrical contacts can be spaced from the first plurality of electrical contacts along a transverse direction that is substantially perpendicular to both the mating and lateral directions. The first plurality of electrical contacts terminate at a first distal end that is configured to mate with a complementary electrical contact of the complementary electrical connector, and the second plurality of electrical contacts terminate at a second distal end configured to mate with a complementary electrical contact of the complementary electrical connector. The distal end of the beams extends beyond the first distal end of the first plurality of electrical contacts along the mating direction, and the distal end of the shrouds extends beyond the second distal end of the second plurality of electrical contacts along the mating direction.

BRIEF DESCRIPTION OF THE DRAWINGS

The foregoing summary, as well as the following detailed description of example embodiments, are better understood when read in conjunction with the appended diagrammatic drawings. For the purpose of illustrating the invention, the drawings show illustrative embodiments. The invention is not limited, however, to the specific embodiments disclosed in the drawings.

DETAILED DESCRIPTION OF ILLUSTRATIVE EMBODIMENTS

Figure 1:
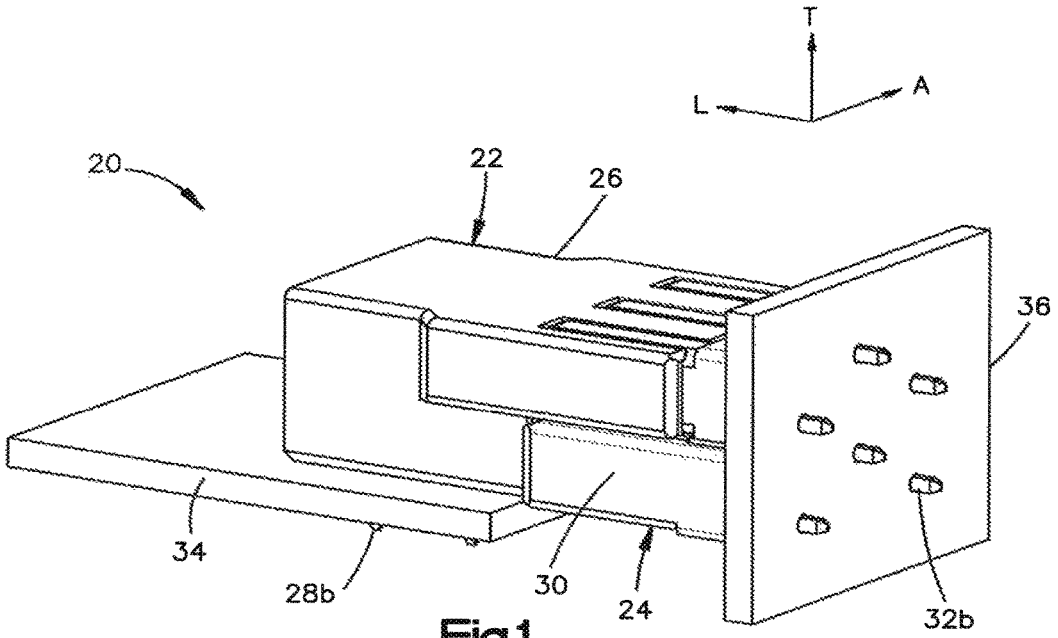
FIG. 1 is a perspective view of an electrical power connector assembly including first and second electrical connectors configured to be mounted to respective first and second substrates.
Figure 2A:
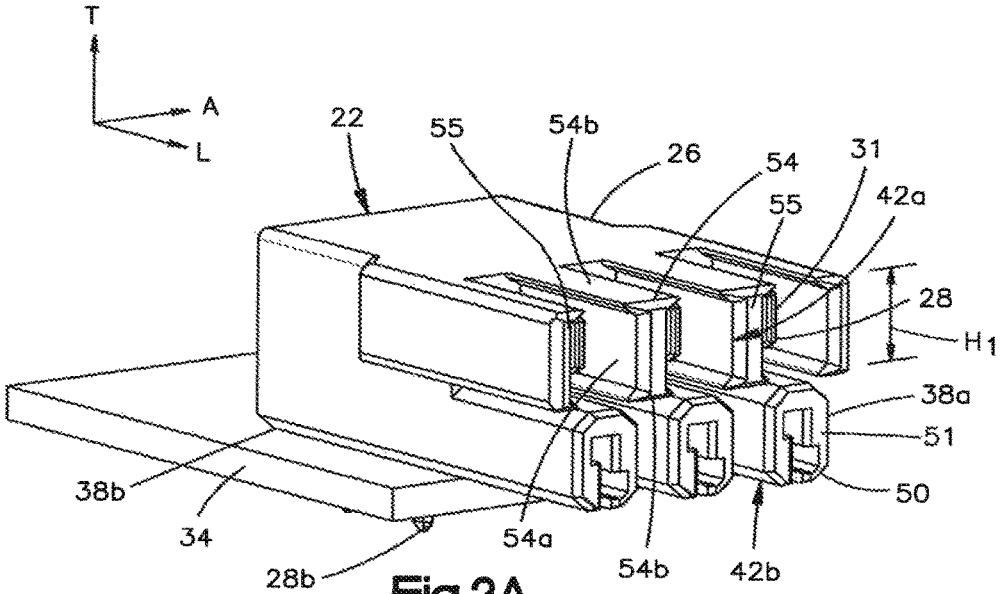
FIG. 2A is a perspective view of the first electrical connector illustrated in FIG. 1 shown mounted to the first substrate.
Figure 2B:
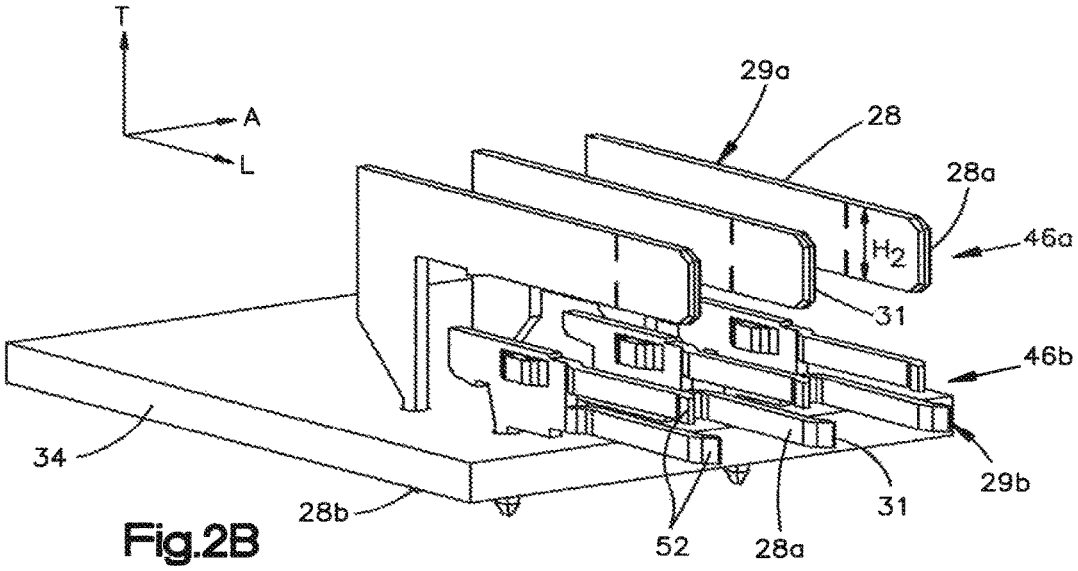
FIG. 2B is a perspective view similar to FIG. 2A, but with the housing of the first electrical connector removed.
Figure 3A:
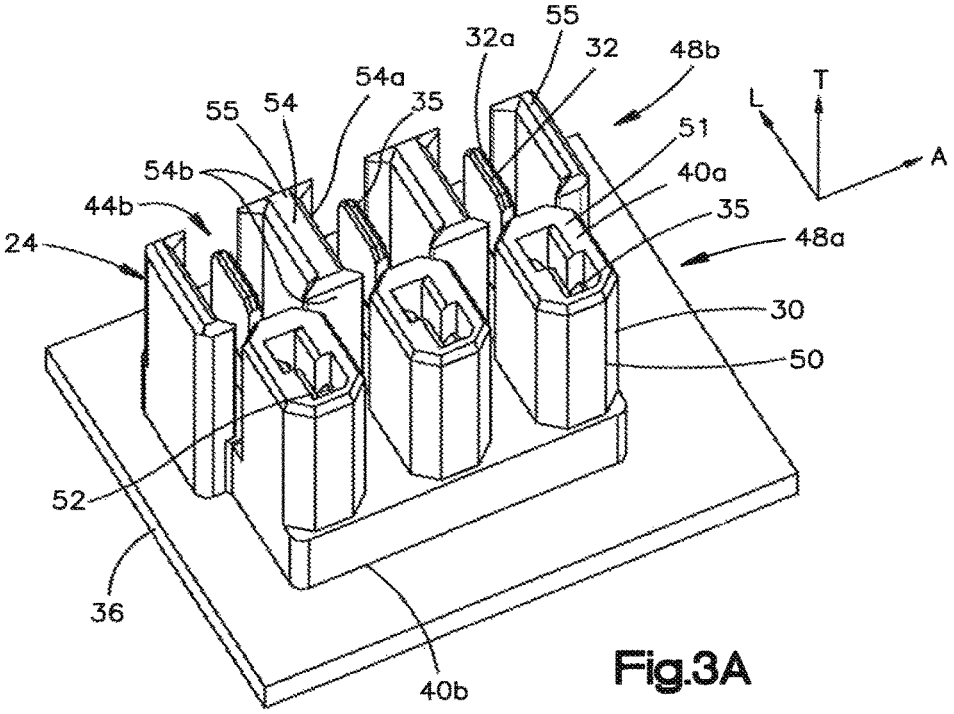
FIG. 3A is a perspective view of the second electrical connector illustrated in FIG. 1 shown mounted to the second substrate.
Figure 3B:
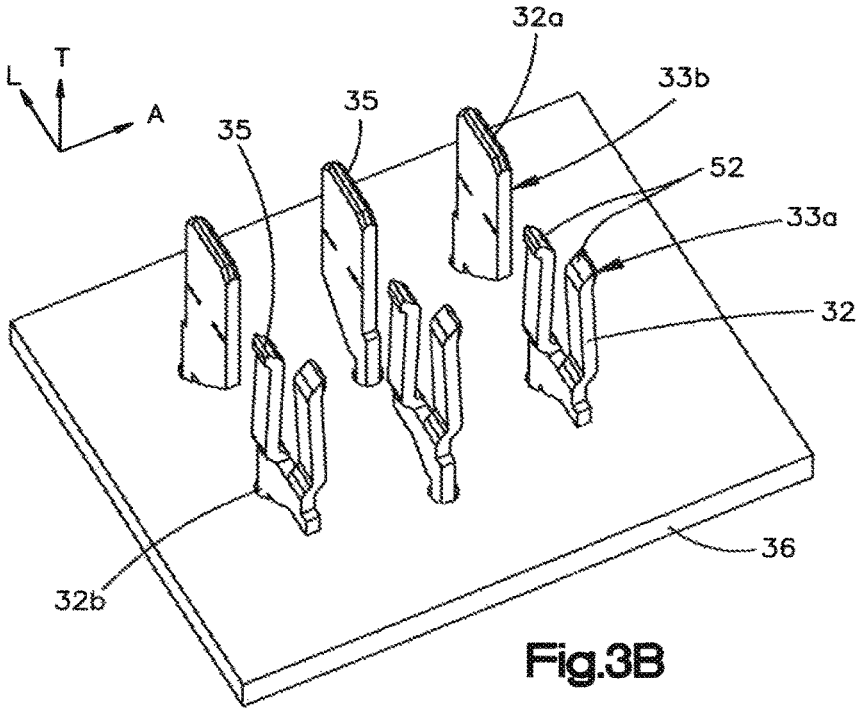
FIG. 3B is a perspective view similar to FIG. 3A, but with the housing of the first electrical connector removed.

Referring initially to FIGS. 1-3B, 7A, and 7B, an electrical connector assembly 20 includes a first electrical connector 22 and a second electrical connector 24 configured to mate with the first electrical connector. The first electrical connector 22 includes a dielectric or electrically insulative connector housing 26 and at least one electrical contact 28 such as a plurality of electrical contacts 28 supported by the connector housing 26. Similarly, the second electrical connector 24 includes a dielectric or electrically insulative connector housing 30 and at least one electrical contact 32 such as a plurality of electrical contacts 32 supported by the connector housing 30. Each of the first and second electrical connectors 22 and 24 can be configured as an electrical power connector as illustrated, and thus is configured to transfer electrical power between a respective complementary electrical component and the other of the first and second electrical connectors 22 and 24. Thus, the electrical contacts 28 and 32 can include electrical power contacts configured to carry electrical power, and the electrical connector assembly 20 can be referred to as an electrical power connector assembly. It should be appreciated that one or more of the electrical contacts 28 can additionally or alternatively be configured as electrical signal contacts configured to carry data signals, and one or more of the electrical contacts 28 can alternatively or additionally be configured as ground contacts. Similarly, it should be appreciated that one or more of the electrical contacts 32 can additionally or alternatively be configured as electrical signal contacts configured to carry data signals, and one or more of the electrical contacts 32 can alternatively or additionally be configured as ground contacts. The electrical connector assembly 20 can further include a first complementary electrical component, such as a first substrate 34 that can be configured as a printed circuit board that includes a plurality of electrical traces, and a second complementary electrical component, such as a second substrate 36 that can be configured as a printed circuit board that includes a plurality of electrical traces.

The first and second electrical connectors 22 and 24 are configured to be mated to each other so as to establish an electrical connection between the first and second electrical connectors 22 and 24. For instance, the electrical contacts 28 can define respective mating portions 28*a* and respective mounting portions 28*b* opposite the mating portions 28*a*. Similarly, the electrical contacts 32 can define respective mating portions 32*a* and respective mounting portions 32*b* opposite the mating portions 32*a*. In one embodiment, each of the electrical contacts 32 include only one mounting portion 32*b*, and each of the electrical contacts 28 include only one mounting portion 28*b*. The mating portions 28*a* and 32*a* are configured to mate with each other as the electrical connectors 22 and 24 are mated to each other so as to place respective ones of the electrical contacts 28 and 32 in electrical communication with each other. Further, the electrical contacts 28 can terminate at respective free distal ends 31 that are configured to mate with a complementary electrical contact of a complementary electrical connector, for instance the electrical contacts 32 of the second electrical connector 24. Similarly, the electrical contacts 32 can terminate at respective free distal ends 35 that are configured to mate with a complementary electrical contact of a complementary electrical connector, for instance the electrical contacts 28 of the first electrical connector 22. Thus, the mating portion 28*a* can include the distal end 31, and the mating portion 32*a* can include the distal end 35. The first electrical connector 22 can be configured to be mounted to the first complementary electrical component so as to place the electrical connector 22 and the first complementary electrical component in electrical communication with each other. The second electrical connector 24 can be configured to be mounted to the second complementary electrical component so as to place the second electrical connector 24 and the second complementary electrical component in electrical communication with each other. For instance, the mounting portions 28*b* are configured to be placed in electrical communication with respective ones of the electrical traces of the first substrate 34 when the first electrical connector 22 is mounted to the first substrate 34. Thus, the first substrate 34 can be placed in electrical communication with the second electrical connector 24 when the electrical connector 22 is mounted to the first substrate 34 and mated with the second electrical connector 24. Similarly, the mounting portions 32*b* are configured to be placed in electrical communication with respective ones of the electrical traces of the second substrate 36 when the second electrical connector 24 is mounted to the second substrate 36. Thus, the second substrate 36 can be placed in electrical communication with the first electrical connector 22 when the second electrical connector 24 is mounted to the second substrate 36 and mated with the first electrical connector 22. Accordingly, the substrates 34 and 36 are placed in electrical communication with each other when the first electrical connector 22 is mounted to the first substrate 34, the second electrical connector 24 is mounted to the second substrate 36, and the first and second electrical connectors 22 and 24 are mated with each other.

The mounting portions 28*b* can be press-fit tails that are configured to be inserted, or press-fit, into respective vias of the respective first substrate 34, thereby electrically connecting the mounting portions 28*b* and the corresponding electrical contacts 28 to respective electrical traces of the first substrate 34 when the first electrical connector 22 is mounted to the first substrate 34. The vias can be configured as plated through-holes that electrically connect the mounting portions 28*b* to respective electrical traces of the underlying first substrate 34. While the mounting portions 28*b* are configured as press-fit tails, it should be appreciated that the mounting portions can be configured to be placed in electrical communication with electrical traces of the first substrate 34 in accordance with any suitable alternative embodiment. For instance, the mounting portions 28*b* can be surface mounted and configured to be fused, for instance soldered, to complementary contact pads of the first substrate 34, so as to place the mounting portions 28*b* in electrical communication with the electrical traces.

Similarly, the mounting portions 32*b* can be press-fit tails that are configured to be inserted, or press-fit, into respective vias of the respective second substrate 36, thereby electrically connecting the mounting portions 32*b* and the corresponding electrical contacts 32 to respective electrical traces of the second substrate 36 when the second electrical connector 24 is mounted to the second substrate 36. The vias can be configured as plated through-holes that electrically connect the mounting portions 32*b* to respective electrical traces of the underlying second substrate 36. While the mounting portions 32*b* are configured as press-fit tails, it should be appreciated that the mounting portions can be configured to be placed in electrical communication with electrical traces of the second substrate 36 in accordance with any suitable alternative embodiment. For instance, the mounting portions 32*b* can be surface mounted and configured to be fused, for instance soldered, to complementary contact pads of the second substrate 36, so as to place the mounting portions 32*b* in electrical communication with the electrical traces.

The connector housing 26 defines a mating interface 38*a* and a mounting interface 38*b*. The first electrical connector 22 can be configured as a right-angle connector, such that the mating interface 38*a* and the mounting interface 38*b* are oriented perpendicular with respect to each other. For instance, the mating interface 38*a* can be at least partially defined by a front end of the connector housing 26, and the mounting interface 38*b* can be at least partially defined by a bottom end of the connector housing 26. Alternatively, the first electrical connector 22 can be configured as a vertical connector, whereby the mating interface 38*a* is oriented parallel to the mounting interface 38*b*. For instance, the mating interface 38*a* can be at least partially defined by the front end of the connector housing 26, and the mounting interface 38*b* can be at least partially defined by a rear end of the connector housing 26. The electrical contacts 28 can be supported by the connector housing 26 such that the mating portions 28*a* are disposed proximate to the mating interface 38*a*, and the mounting portions 28*b* are disposed proximate to the mounting interface 38*b*. Thus, when the first electrical connector 22 is configured as a right-angle electrical connector, the mating portions 28*a* are oriented perpendicular with respect to the mounting portions 28*b*. Alternatively, if the first electrical connector 22 is configured as a vertical electrical connector, the mating portions 28*a* are oriented parallel with respect to the mounting portions 28*b*.

Similarly, the connector housing 30 defines a mating interface 40*a* and a mounting interface 40*b*. The second electrical connector 24 can be configured as a vertical connector, such that the mating interface 38*a* and the mounting interface are oriented parallel with respect to each other. For instance, the mating interface 38*a* can be at least partially defined by a front end of the connector housing 30, and the mounting interface 38*b* can be at least partially defined by a rear end of the connector housing 40. Alternatively, the second electrical connector 24 can be configured as a right-angle connector, whereby the mating interface 40*a* is oriented perpendicular with respect to the mounting interface 40*b*. For instance, the mating interface 40*a* can be at least partially defined by the front end of the connector housing 40, and the mounting interface 40*b* can be at least partially defined by a rear end of the connector housing 30. The electrical contacts 32 can be supported by the connector housing 40 such that the mating portions 32*a* are disposed proximate to the mating interface 40*a*, and the mounting portions 32*b* are disposed proximate to the mounting interface 40*b*. Thus, when the second electrical connector 24 is configured as a vertical electrical connector, the mating portions 32*a* are oriented parallel with respect to the mounting portions 32*b*. Alternatively, if the second electrical connector 24 is configured as a right-angle electrical connector, the mating portions 32*a* are oriented perpendicular with respect to the mounting portions 32*b*.

Various structures of the electrical connector assembly 20, including each of the first electrical connector 22 and the second electrical connector 24, are described herein as extending horizontally along a first or longitudinal direction "L" and a second or lateral direction "A" that is substantially perpendicular to the longitudinal direction L, and vertically along a third or transverse direction "T" that is substantially perpendicular to each of the longitudinal direction L and the lateral directions A. Thus, unless otherwise specified herein, the terms "lateral," "longitudinal." and "transverse" are used to describe the orthogonal directional components of various components. Further, the term "in" when used with a specified direction component is intended to refer to the single specified direction, and the term "along" when used with a specified direction component is intended to refer to either or both of opposed directions. It should be appreciated that while the longitudinal and lateral directions are illustrated as extending along a horizontal plane, and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector assembly 20 and its components as illustrated merely for the purposes of clarity and convenience, it being appreciated that these orientations may change during use.

As illustrated, the first electrical connector 22 is configured to be mated to the second electrical connector 24 along a respective forward mating direction, and unmated from the second electrical connector 24 along a respective rearward direction. Similarly, the second electrical connector 24 is configured to be mated to the first electrical connector 22 along a respective forward mating direction, and unmated from the first electrical connector 22 along a respective rearward direction. Both the forward and rearward directions of each of the first and second electrical connectors 22 and 24 are defined along the longitudinal direction L. Thus, the mating portions 38*a* and 40*a* of the electrical contacts are oriented generally along the longitudinal direction L. The respective mounting portions are oriented generally along the longitudinal direction L when the electrical connector is configured as a vertical connector, and along the transverse direction T when the electrical connector is configured as a right-angle connector. Further, the front and rear ends of the connector housings 26 and 30 of the first and second electrical connectors 22 and 24, respectively, are spaced along the longitudinal direction L. Top and bottom ends of the connector housings 26 and 30 of the first and second electrical connectors 22 and 24, respectively, are spaced along the transverse direction T.

With continuing reference to FIGS. 1-3B, 7A, and 7B, the mating interface 38*a* can be configured to receive, or be received by, the mating interface 40*a*. Thus, the mating interface 40*a* can be configured to receive, or be received by, the mating interface 38*a*. Alternatively still, a first portion 42*a* of the mating interface 38*a* can be configured to receive a corresponding first portion 44*a* of the mating interface 40*a*, and a second portion 42*b* of the mating interface 38*a* can be configured to be received by a corresponding second portion 44*b* of the mating interface 40*a*. Thus, the first portion 44*a* of the mating interface 40*a* can be configured to be received by the corresponding first portion 42*a* of the mating interface 38*a*, and the second portion 44*b* of the mating interface 40*a* can be configured to receive the corresponding second portion 42*b* of the mating interface 38*a*. Alternatively still, the first portion 42*a* of the mating interface 38*a* can be configured to be received by the corresponding first portion 44*a* of the mating interface 40*a*, and the second portion 42*b* of the mating interface 38*a* can be configured to receive the corresponding second portion 44*b* of the mating interface 40*a*. Thus, the first portion 44*a* of the mating interface 40*a* can be configured to receive the corresponding first portion 42*a* of the mating interface 38*a*, and the second portion 44*b* of the mating interface 40*a* can be configured to be received by the corresponding second portion 42*b* of the mating interface 38*a*.

It will be understood that the first and second electrical connectors 22 and 24 can be shaped as desired. Referring to an alternative embodiment illustrated in FIGS. 8A-D, a first electrical connector 22*a* and a second electrical connector can be mated with each other to define an alternative electrical connector assembly 20*a*. As shown, the mating interface 38*a* can be configured to receive, or be received by, the mating interface 40*a*. Thus, the mating interface 40*a* can be configured to receive, or be received by, the mating interface 38*a*. Furthermore, as shown, the first portion 42*a* of the mating interface 38*a* is configured to receive the corresponding first portion 44*a* of the mating interface 40*a*, and a second portion 42*b* of the mating interface 38*a* can be configured to be received by a corresponding second portion 44*b* of the mating interface 40*a*. Thus, the first portion 44*a* of the mating interface 40*a* can be configured to be received by the corresponding first portion 42*a* of the mating interface 38*a*, and the second portion 44*b* of the mating interface 40*a* can be configured to receive the corresponding second portion 42*b* of the mating interface 38*a*. For instance, the connector housing 26 can define a housing body 26*a*, and the second portions 42*b* can project out from the housing body 26*a* along the mating direction a first distance. Similarly, the connector housing 30 can define a housing body 30*a*, and the first portions 44*a* can project out from the housing body 30*a* along the mating direction a second distance that is substantially equal to the first distance.

The first electrical connector 22 can include electrical contacts 28 that are constructed as desired so that the respective mating portions 28*a* are touch proof. Similarly, the second electrical connector can include electrical contacts 32 that are constructed as desired so that the respective mating portions 32*a* are touch proof. In accordance with an alternative embodiment, referring to FIGS. 8A-D, the first electrical connector 22*a* includes electrical contacts 28' that include header and receptacle contacts. For instance, the second portions 42*b* of the first electrical connector 22*a* can be constructed so as to define a plurality of slots. The mating portions 28*a* of the electrical contacts 28 that are configured as headers of the first electrical connector 22*a* can be disposed within the slots. The mating portions 28*a* of the electrical contacts 28 configured as receptacles can be disposed within the first portions 42*a* of the first electrical connector 22*a*. Similarly, the first portions 44*a* of the second electrical connector 24*a* can be constructed so as to define a plurality of slots. The mating portions 32*a* of the electrical contacts 32 configured as headers of the second electrical connector 24*a* can be disposed within the slots. The mating portions 32*a* of the electrical contacts 32 configured as receptacles can be disposed within the second portions 44*b* of the second electrical connector 24*a*. As shown, the mating portions 28*a* of the receptacle contacts of the first electrical connector 22*a* can each include two fingers 52 spaced from each other along the lateral direction A. Similarly, the mating portions 32*a* of the receptacle contacts 32 of the second electrical connector 24*a* can each include two fingers 52 spaced apart from each other along the lateral direction A. The mating portions 28*a* of the plug contacts of the first electrical connector 22*a* can each define opposed broad surfaces that are configured to be received in between the two fingers 52 of the second electrical connector 24*a* when the first electrical connector 22*a* is mated with the second electrical connector 24*a* so that the each of the broad surfaces contacts a respective finger 52, so as to establish an electrical power connection between the first and second electrical connectors 22*a* and 24*a*. The mating portions 32*a* of the plug contacts of the second electrical connector 24*a* can each define opposed broad surfaces that are configured to be received in between the two fingers 52 of the first electrical connector 22*a* when the first electrical connector 22*a* is mated with the second electrical connector 24*a* so that the each of the broad surfaces contacts a respective finger 52, so as to establish an electrical power connection between the first and second electrical connectors 22*a* and 24*a*.

Figure 8A:
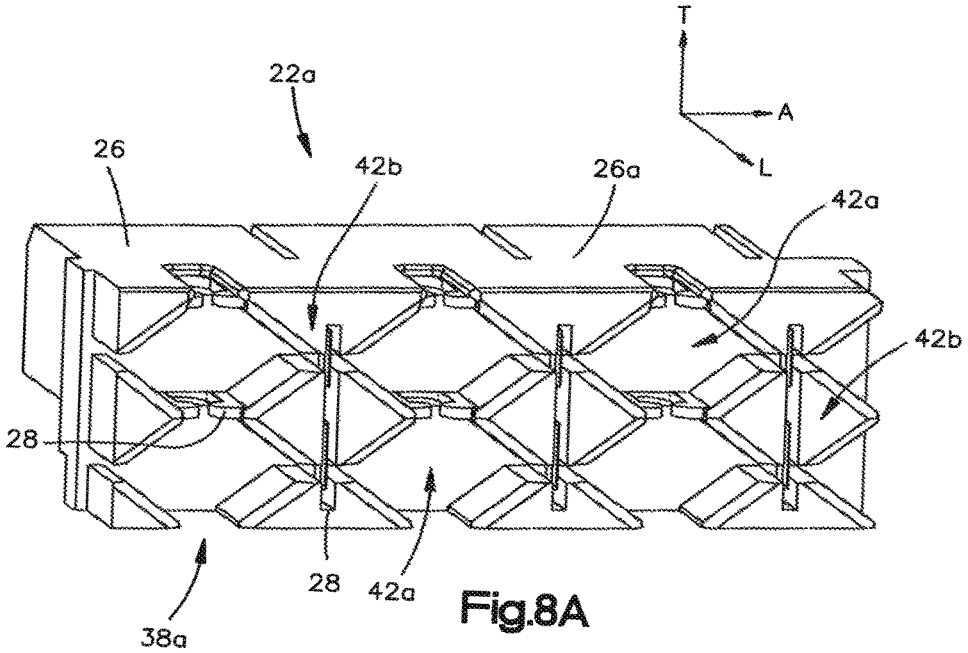
FIG. 8A is a perspective view of another first electrical connector constructed in accordance with yet another alternative embodiment.
Figure 8B:
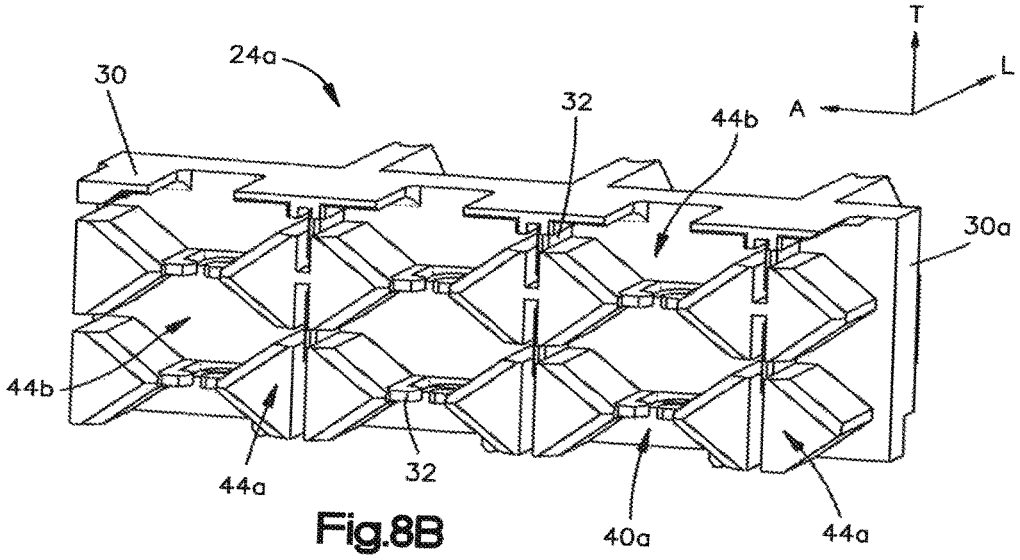
FIG. 8B is a perspective view of another second electrical connector constructed in accordance with yet another alternative embodiment.
Figure 8C:
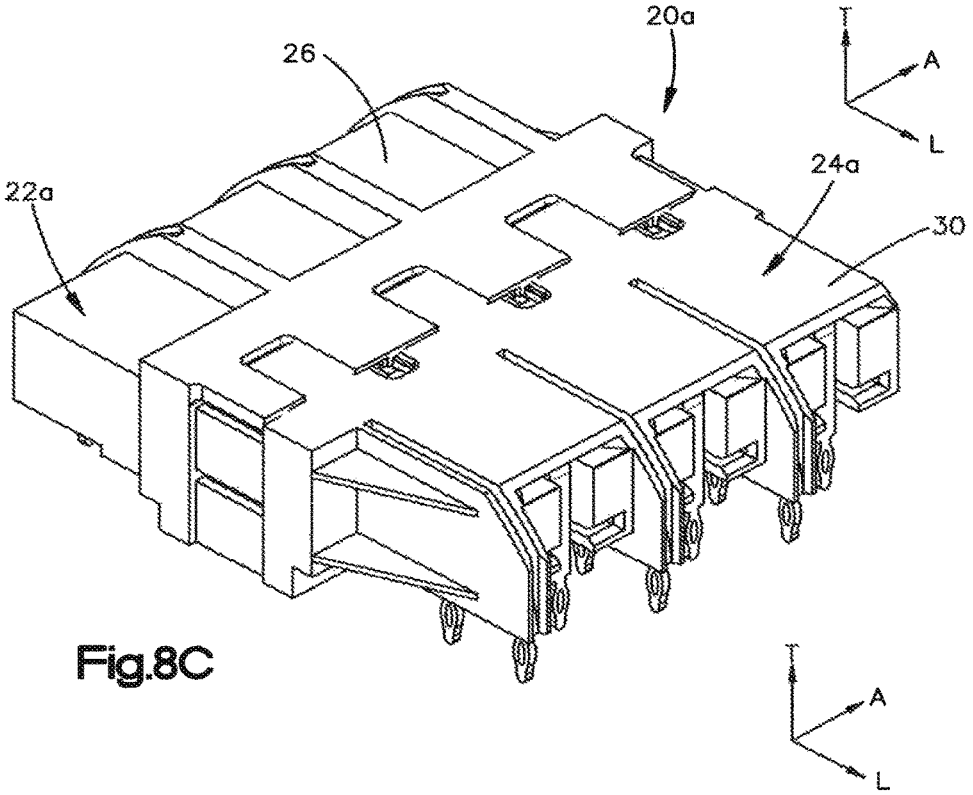
FIG. 8C is a perspective view of another electrical power connector assembly constructed in accordance with another alternative embodiment, including the first electrical connector of FIG. 8A mated with the second electrical connector of FIG. 8B.
Figure 8D:
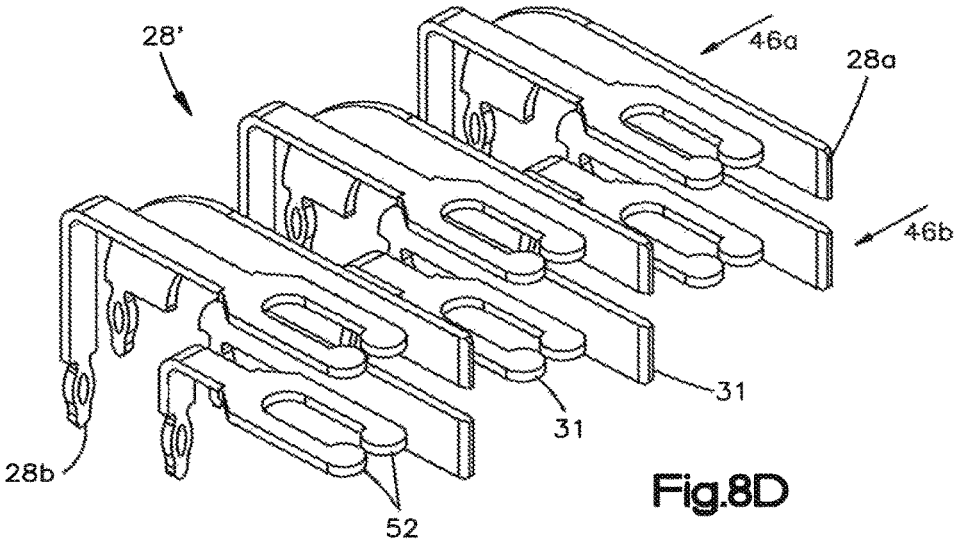
FIG. 8D is a perspective view of the electrical connector shown in FIG. 8A, shown with the housing removed.

Thus, it will be understood that the connector housing 30 can include a housing body 30*a* and a plurality of first portions 44*a* that extend from the housing body 30*a* along the mating direction. The electrical contacts 32 can each terminate at a mating portion 32*a* configured to mate with complementary electrical contacts of a complementary electrical connector. The mating portions 32*a* can be arranged in a plurality of columns that extend along a column direction, and the columns can be spaced from each other along a row direction that is substantially perpendicular to the column direction. The electrical contacts 32 include plug contacts and receptacle contacts, and the first portions 44*a* can extend farther from the housing body 30*a* relative to the mating portions 32*a* of the electrical contacts 32 along the mating direction such that each of the electrical contacts 32 is touch proof. In accordance with the illustrated embodiment, each column includes only one of plug contacts or receptacle contacts. Further, adjacent columns along the row direction can define an alternating pattern of plug and receptacle contacts such that no plug contacts are immediately adjacent to receptacle contacts along the row direction. The first portions 44*a* can be substantially diamond shaped. The first portions 44*a* can be sized to be received by complementary portions of a complementary connector housing of the complementary electrical power connector when the electrical power connector is mated with the complementary electrical power connector. The first portions 44*a* can define a plurality of slots, and the mating portions 32*a* of the plug contacts can be disposed within respective slots. As shown, the slots can be elongate along the column direction. The first portions 44*a* can define the second portions 44*b*. The second portions 44*b* can be sized to receive complementary portions of a complementary connector housing of the complementary electrical connector when the electrical power connector is mated with the complementary electrical power connector. Thus, still referring to FIG. 8, in accordance with the illustrated embodiment, the first portions 44*a* can be substantially diamond shaped and can be arranged so as to define the second portions 44*b* that are substantially diamond shaped. Referring also to FIG. 8D, the receptacle contacts can define fingers 52 that are spaced apart from each other along the row direction such that the fingers are configured to receive therebetween a complementary plug contact of the complementary electrical power connector when the electrical power connector is mated with the complementary power connector. As shown, each of the receptacle contacts can be disposed immediately adjacent two first portions 44*a* along the row direction and two second portions 44*b* along the column direction.

The mating portions 28*a* of at least a portion up to all of the plurality of electrical contacts 28 of the first electrical connector 22 can be arranged in at least one row 46, such as at least a first row 46*a* and at least a second row 46*b* that is spaced from the first row 46*a* along the transverse direction T. Each mating portion 28*a* in the first row 46*a* can be aligned with a respective mating portion 28*a* in the second row 46*b* along the transverse direction T. Each of the first and second rows 46*a* and 46*b* can extend along the lateral direction A. Adjacent mating portions 28*a* in the rows 46 can be spaced apart any pitch as desired, for instance between 1 to 5 mm. In accordance with one embodiment, referring to FIG. 7A, adjacent mating portions 28*a* in the same row are spaced apart from each other approximately 2 mm along the lateral direction A. In accordance with another embodiment, referring to FIG. 2B, the mating portions 28*a* in the same row can be spaced apart from each other approximately 4 mm along the lateral direction A. The first row 46*a* can be disposed above the second row 46*b*, and can thus be referred to as an upper row, and the second row 46*b* can be disposed below the first row 46*a* and can thus be referred to as a lower row. Thus, it can be said that electrical contacts in the first row 46*a* are on top of electrical contacts in the second row 46*b*. For instance, when the first electrical connector 22 is configured as a right-angle electrical connector 22, the first row 46*a* can be spaced from the mounting interface 38*b* a distance along the transverse direction T that is greater than the distance along the transverse direction T that the second row 46*b* is spaced from the mounting interface 38*b*. The first portion 42*a* of the mating interface 38*a* can be disposed at the first row 46*a*, and the second portion 42*b* of the mating interface 38*a* can be disposed at the second row 46*b*.

Similarly, the mating portions 32*a* of at least a portion up to all of the plurality of electrical contacts 32 of the second electrical connector 24 can be arranged in at least one row 48, such as at least a first row 48*a* and at least a second row 48*b* that is spaced from the first row 48*a* along the transverse direction T. Each mating portion 32*a* in the first row 48*a* can be aligned with a respective mating portion 32*a* in the second row 48*b* along the transverse direction T. Each of the first and second rows 48*a* and 48*b* can extend along the lateral direction A. Adjacent mating portions 32*a* in the rows 48 can be spaced apart any pitch as desired, for instance between 1 to 5 mm. In accordance with one embodiment, referring to FIG. 7B, adjacent mating portions 32*a* in the same row are spaced apart from each other approximately 2 mm along the lateral direction A. In accordance with another embodiment, referring to FIG. 3A, the mating portions 32*a* in the same row can be spaced apart from each other approximately 4 mm along the lateral direction A. The first row 48*a* can be disposed above the second row 48*b*, and can thus be referred to as an upper row, and the second row 48*b* can be disposed below the first row 48*a* and can thus be referred to as a lower row. Thus, it can be said that electrical contacts in the first row 48*a* are on top of electrical contacts in the second row 48*b*. For instance, when the second electrical connector 24 is configured as a right-angle electrical connector, the first row 48*a* can be spaced from the mounting interface 40*b* a distance along the transverse direction T that is greater than the distance along the transverse direction T that the second row 48*b* is spaced from the mounting interface 40*b*. The first portion 44*a* of the mating interface 40*a* can be disposed at the first row 48*a*, and the second portion 44*b* of the mating interface 40*a* can be disposed at the second row 48*b*.

The mating portions 28*a* at the first row 46*a* of the first electrical connector 22 can be configured as plugs that are configured to be received by complementary receptacle mating portions 32*a* of the first row 48*a* of the second electrical connector 24, and the mating portions 28*a* of the second row 46*b* of the first electrical connector 22 can be configured as receptacles that are configured to receive complementary plug mating portions 32*a* of the second row 48*b* of the second electrical connector. Thus, the mating portions 28*a* of the plug contacts can be on top of the mating portions 28*a* of the receptable contacts. The mating portions 32*a* at the first row 48*a* of the second electrical connector 24 can be configured as receptacles that are configured to receive complementary plug mating portions 28*a* of the first row 46*a* of the first electrical connector 22, and the mating portions 32*a* of the second row 48*b* of the second electrical connector 24 can be configured as plugs that are configured to be received by complementary receptacle mating portions 28*a* of the second row 46*b* of the first electrical connector. Thus, the mating portions 32*a* of the receptacle contacts can be on top of the mating portions 32*a* of the plug contacts. Alternatively, the mating portions 28*a* at the first row 46*a* of the first electrical connector 22 can be configured as receptacles that are configured to receive by complementary plug mating portions 32*a* of the first row 48*a* of the second electrical connector 24, and the mating portions 28*a* of the second row 46*b* of the first electrical connector 22 can be configured as plugs that are configured to be received by complementary receptacle mating portions 32*a* of the second row 48*b* of the second electrical connector 24. Thus, the mating portions 32*a* at the first row 48*a* of the second electrical connector 24 can be configured as plugs that are configured to be received by complementary receptacle mating portions 28*a* of the first row 46*a* of the first electrical connector 22, and the mating portions 32*a* of the second row 48*b* of the second electrical connector can be configured as receptacles that are configured to receive by complementary receptacle mating portions 28*a* of the second row 46*b* of the first electrical connector. Thus, the mating portions 28*a* of the receptacle contacts can be on top of the mating portions 28*a* of the plug contacts, and the mating portions 32*a* of the plug contacts can be on top of the mating portions 21*a* of the receptacle contacts.

Figure 7A:
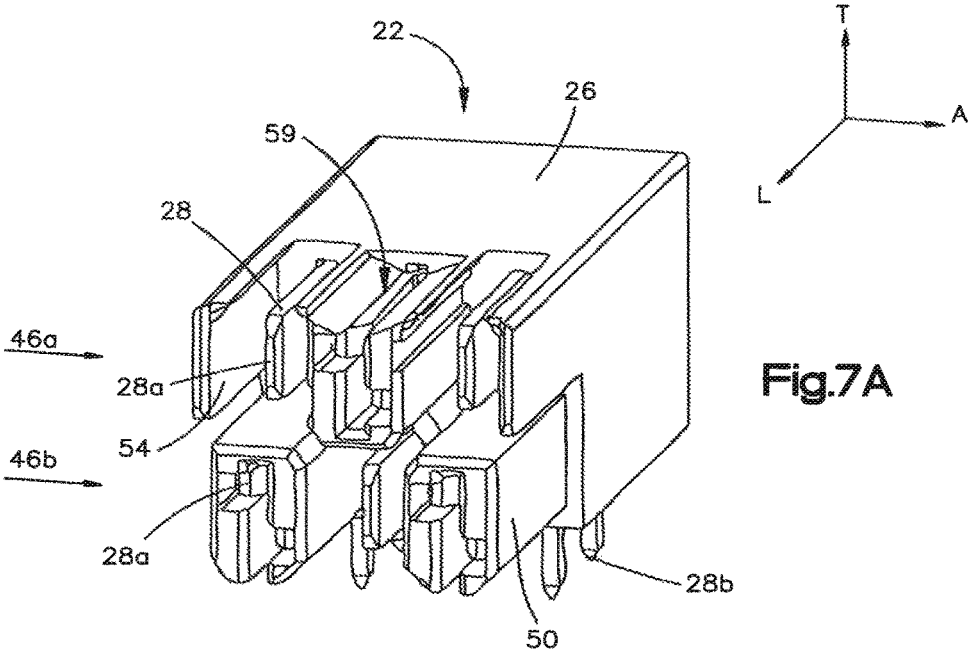
FIG. 7A is a perspective view of the first electrical connector constructed in accordance with an alternative embodiment.

Alternatively still, referring to FIGS. 7A-B and 8A-D, at least one of mating portions 28*a* at the first row 46*a* of the first electrical connector 22 can be configured as a plug that is configured to be received by a complementary receptacle mating portions 32*a* of the first row 48*a* of the second electrical connector 24, and at least one of the mating portions 28*a* at the first row 46*a* of the first electrical connector 22 can be configured as a receptacle that is configured to receive a complementary plug mating portion 32*a* at the first row 48*a* of the second electrical connector 24. At least one of the mating portions 28*a* at the second row 46*b* of the first electrical connector 22 can be configured as a plug that is configured to be received by a complementary receptacle mating portions 32*a* of the second row 48*b* of the second electrical connector 24, and at least one of the mating portions 28*a* at the second row 46*b* of the first electrical connector 22 can be configured as a receptacle that is configured to receive a complementary plug mating portion 32*a* at the second row 48*b* of the second electrical connector 24. For instance, as shown in FIG. 7A, the first electrical connector 22 can include mating portions 28*a* that alternately are configured as plugs and receptacles along each of the rows 46. Thus, every other mating portion 28*a* can be configured as a plug along the first row 46*a*, and every other mating portion 28*a* can be configured as a receptacle along the second row 46*b*. Stated another way, the first row 46*a* can define a repeating pattern of plug-receptacle contacts, and the second row 46*b* can include a repeating pattern of receptacle-plug contacts. Similarly, the second electrical connector 24 can include mating portions 32*a* that alternately are configured as plugs and receptacles along each of the rows 48. Thus, every other mating portion 32*a* can be configured as a receptacle along the first row 48*a*, and every other mating portion 32*a* can be configured as a plug along the second row 46*b*. Stated another way, the first row 48*a* can define a repeating pattern of plug-receptacle contacts, and the second row 48*b* can include a repeating pattern of receptacle-plug contacts.

Further, the first plurality of electrical contacts 29*a* and the second plurality of electrical contacts 29*b* can be arranged in the first row 46*a* along the lateral direction A such that every other electrical contact 28 in the first row 46*a* is configured as a plug contact that is aligned with a receptacle contact, in particlar the mating portion 28*a* of the receptacle contact, along the transverse direction T that is substantially perpendicular to the lateral direction A and the mating direction of the electrical power connector 22 (e.g., see FIG. 7A). Similarly, the first plurality of electrical contacts 33*a* and the second plurality of electrical contacts 33*b* can be arranged in the first row 48*a* along the lateral direction A such that every other electrical contact 32 in the first row 48*a* is configured as a plug contact that is aligned with a receptacle contact, in particular the mating portion 32*a* of the receptacle contact, along the longitudinal direction L that is substantially perpendicular to the lateral direction A and the transverse direction T (e.g., see FIG. 7B).

As used herein, electrical contacts having plug mating portions are often referred to as plug contacts, and electrical contacts having receptacle mating portions are often referred to as receptacle contacts. Thus, it should be appreciated that the electrical contacts 28 can include a first plurality of electrical contacts 29*a* supported by the connector housing 26, for instance such that their respective mating portions 28*a* are aligned along the first row 46*a*, the first plurality of electrical contacts 29*a* being of a first type. The first plurality of electrical contacts 29*a* can be spaced apart from each other along the lateral direction A that is substantially perpendicular to the mating direction. The electrical contacts 28 can include a second plurality of electrical contacts 29*b* supported by the connector housing 26, for instance such that their respective mating portions 28*a* are aligned along the second row 46*b*, the second plurality of electrical contacts 29*b* being of a second type. The second plurality of electrical contacts 29*b* can be spaced from each other along the lateral direction A. The second plurality of electrical contacts 29*b* can be spaced from the first plurality of electrical contacts 29*a* along the transverse direction T that is substantially perpendicular to both the mating and lateral directions. For example, the first type can be one of a plug and a receptacle, and the second type can be the other of a plug and a receptacle. Alternatively still, the first type can include both plugs and receptacles, such that a first group of the first plurality of electrical contacts 29*a* are plug contacts and a second group of the first plurality of electrical contacts 29*a* are receptacle contacts (e.g., see FIGS. 7A and 7B). In accordance with the embodiment illustrated in FIGS. 1-3B, the first plurality of electrical contacts 29*a* are configured as plug contacts, and the second plurality of electrical contacts 29*b* are configured as receptacle contacts.

Similarly, the electrical contacts 32 can include a first plurality of electrical contacts 33*a* supported by the connector housing 30, for instance such that their respective mating portions 32*a* are aligned along the first row 48*a*, the first plurality of electrical contacts 33*a* being of a first type. The electrical contacts 32 can include a second plurality of electrical contacts 33*b* supported by the connector housing 30, for instance such that their respective mating portions 32*a* are aligned along the second row 48*b*, the second plurality of electrical contacts 33*b* being of a second type. For example, the first type can be one of a plug and a receptacle, and the second type can be the other of a plug and a receptacle. Alternatively still, the first type can include both plugs and receptacles, such that a first group of the first plurality of electrical contacts 29*a* are plug contacts and a second group of the first plurality of electrical contacts 29*a* are receptacle contacts. In accordance with the embodiment illustrated in FIGS. 1-3B, the first plurality of electrical contacts 33*a* are configured as receptacle contacts, and the second plurality of electrical contacts 33*b* are configured as plug contacts.

With continuing reference to FIGS. 1-3B, each of the first plurality of electrical contacts 29*a* of the first electrical connector 22 extends along a respective length to the mating portion 28*a*, and the connector housing 26 can extend beyond the mating portions 28*a* along the longitudinal direction L, such that each of the first plurality of electrical contacts 29*a* is touch proof with respect to the longitudinal direction L. Similarly, each of the second plurality of electrical contacts 29*b* extends along a respective length to the mating portion 28*a*, and the connector housing 26 extends beyond the mating portions 28*a* of the second plurality of electrical contacts 29*b* along the longitudinal direction L such that each of the second plurality of electrical contacts 29*b* is touch proof. With continuing reference to FIGS. 1-3B, each of the first plurality of electrical contacts 33*a* of the second electrical connector 24 extends along a respective length to the mating portion 32*a*, and the connector housing 30 can extend beyond the mating portions 32*a* along the longitudinal direction L, such that each of the first plurality of electrical contacts 33*a* is touch proof. Similarly still, each of the second plurality of electrical contacts 33*b* of the second electrical connector 24 extends along a respective length to the mating portion 32*a*, and the connector housing 30 extends beyond the mating portions 32*a* of the second plurality of electrical contacts 33*b* along the longitudinal direction L such that each of the second plurality of electrical contacts 33*b* is touch proof.

Figure 10A:
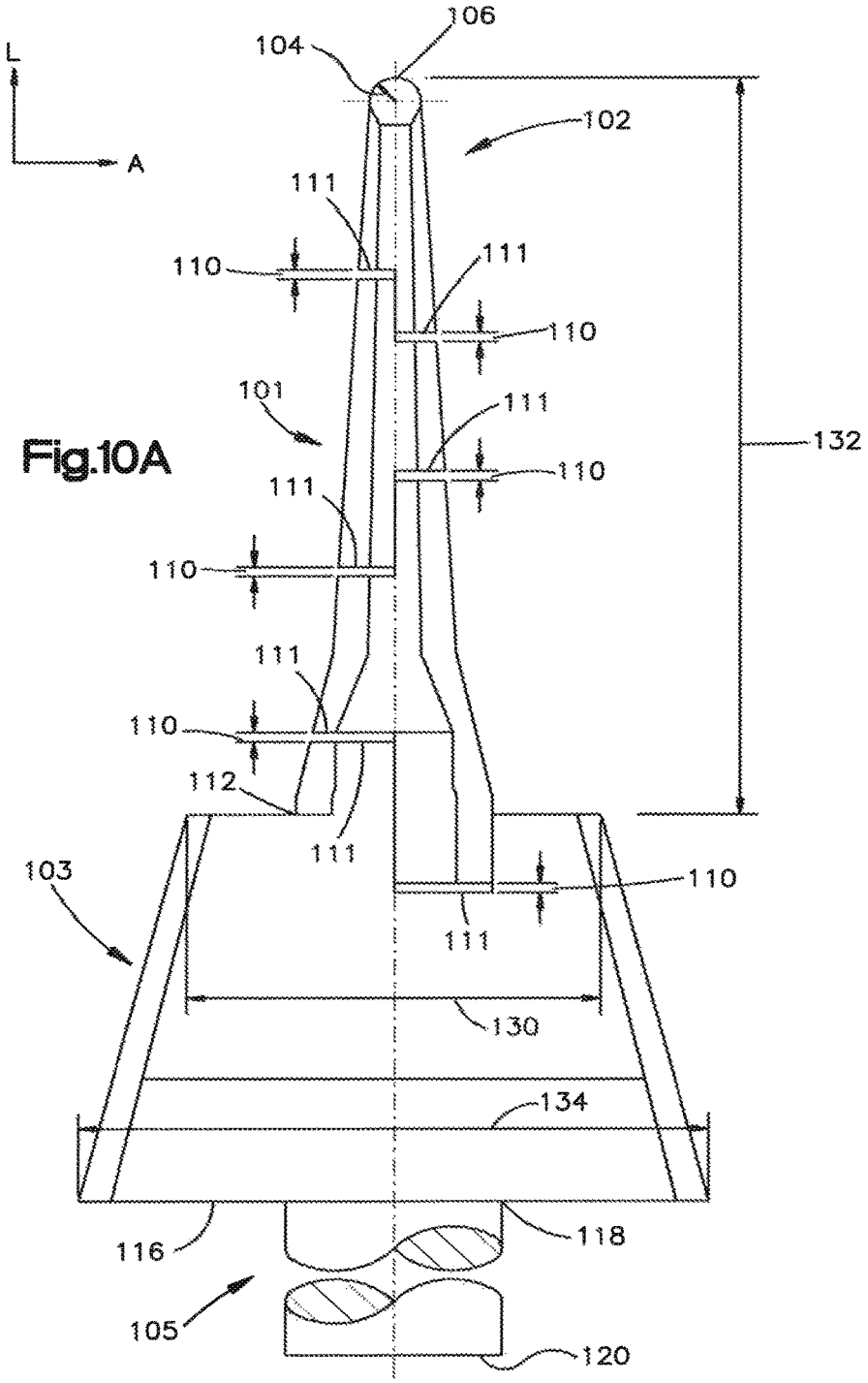
FIG. 10A is a top plan view of a probe used in conjunction with UL Standard 1977, Section 10.2.
Figure 10B:
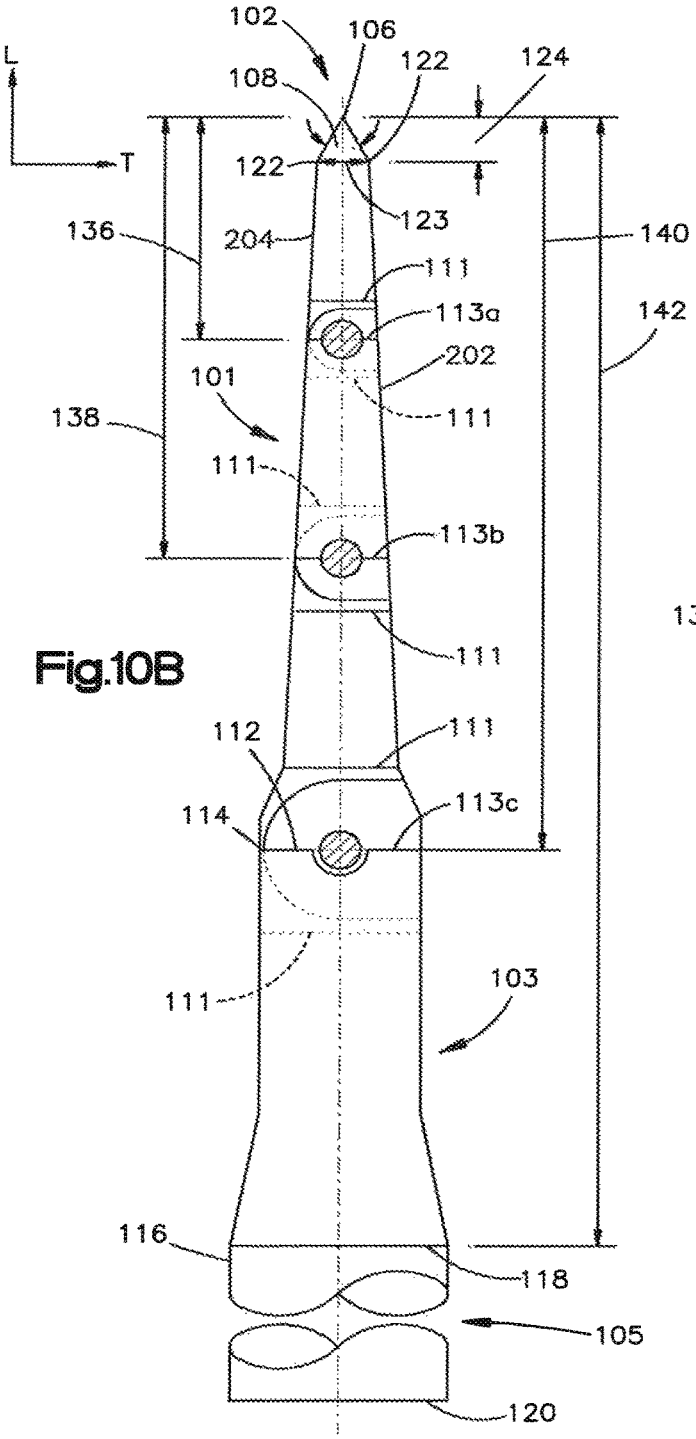
FIG. 10B is a side elevation view of the probe shown in FIG. 10A.
Figure 10C:
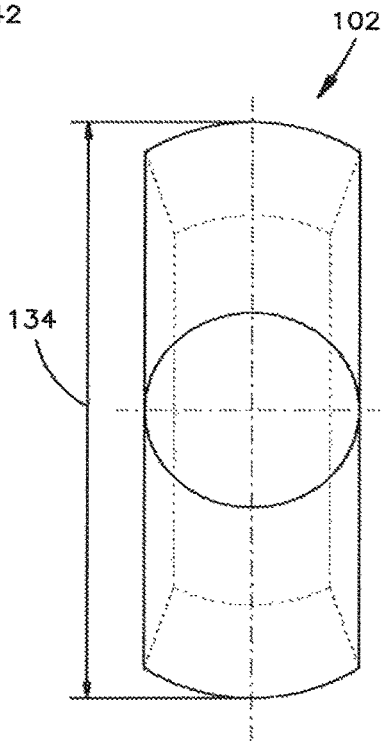
FIG. 10C is a cross section of the probe shown in 10A.

As illustrated in FIGS. 10A-C, reference to one or more of the electrical contacts 28 and 32 as touch proof can be as described in UL Standard 1977, Section 10.2, which is hereby incorporated by reference and requires that the mating devices intended for usage external to the end equipment shall not have exposed live contacts during engagement or withdrawal as determined by the use of a probe 102 shown in FIGS. 10A-C. Descriptions of the probe 102 and how the probe 102 can be used to verify that the electrical contacts 28 and 32 are touch proof are included below. The electrical contacts 28 and 32, and in particular the mating portions 28*a* and 32*a*, can also be considered touch proof because the mating portions 28*a* and 32*a* are blocked from human contact or humans are otherwise prevented from touching the mating portions 28*a* and 32*a* with their fingers.

Referring in particular to FIGS. 10A-C, the probe 102 can also be referred to as a test finger because the probe 102 simulates human finger movement. The probe 102 includes a finger portion 101, a rear portion 105, and a palm portion 103 disposed between the finger portion 101 and the rear portion 105. The finger portion 101, the rear portion 105, and the palm portion 103 can be made of any electrically conductive material as desired, for instance stainless steel. The rear portion 105 can include or be connected to a handle portion, which can be made of nylon. As shown, the finger portion 101 is in a fully extended position such the illustrated finger portion 101 defines a maximum length along the longitudinal direction L. The finger portion 101, and thus the probe 102, defines a distal or front end 106. The finger portion 101 further defines a rear end 112 opposite the distal end 106. When the finger portion 101 is in the fully extended position, as shown, the rear end 112 of the finger portion is spaced from the distal end 106 of the finger portion in a rearwardly longitudinal direction. The palm portion 103 includes a front end 114 and a rear end 116 spaced from the front end 114 along the longitudinal direction L. The rear end 112 of the finger portion 101 is disposed adjacent to the front end 114 of the palm portion 103. The rear portion 105 defines a front end 118 and a rear end 120 spaced from the front end 118 along the longitudinal direction L. The front end 118 of the rear portion 105 is disposed adjacent to the rear end 116 of the palm portion 103, and the rear end 120 of the rear portion 105 can be disposed adjacent to the handle.

As shown, referring in particular to FIG. 10A, the finger portion 101 defines a curved surface along the lateral direction A at the distal end 106. The curved surface defines a radius 104 that is equal to 3.5 millimeters (mm). As shown, referring in particular to FIG. 10B, the finger portion 101 further includes a first or top surface 202 and a second or bottom surface 204 that meets the top surface 202 at the distal end 106. The top and bottom surfaces 202 and 204 extend away from each other rearwardly along the longitudinal direction L to a first location 122. The top and bottom surfaces 202 and 204 are spaced from each along the transverse direction T a distance 123 at the first location 122, which is a location defined along the longitudinal direction L. The distance 123 is 5.8 mm. The first location 122 is a distance 124 from the distal end 106 along the longitudinal direction L. As shown, the distance 124 is 5 mm. Further, the top and bottom surfaces 202 and 204 define an angle 108 with respect to each other at the distal end 106. The angle 108 is approximately 60 degrees.

Still referring to FIGS. 10A-C, the probe 102 defines joints 111, which enable the probe 102 to simulate a human finger. The joints 111 each include a gap that defines a gap distance 110 along the longitudinal direction L when the test finger is in the fully extended position, as shown. The gap distance 110 is 0.05 mm. Center points 113 are centered between pairs of the joints 111 along the longitudinal direction L. A first center point 113*a* is a distance 136 from the distal end 106 along the longitudinal direction L when the probe 102 is in the fully extended position. The distance 136 is 30 mm. A second center point 113*b* is a distance 138 from the distal end 106 along the longitudinal direction L when the probe 102 is in the fully extended position. The distance 138 is 60 mm. A third center point 113*c* is a distance 140 from the distal end 106 along the longitudinal direction L when the probe 102 is in the fully extended position. The distance 140 is 100 mm.

As shown, the front end 114 of the palm portion 103 defines a width 130 along the lateral direction A. The width 130 is 50 mm. The front end 114 is spaced from the distal end 106 a distance 132 along the longitudinal direction L when the finger portion 101 is in the fully extended position. The distance 132 is 100 mm. The rear end 116 of the palm portion 103 defines a width 134 along the lateral direction A. The width 134 is 78 mm. The rear end 116 of the palm portion 103 is spaced from the distal end 106 a distance 142 along the longitudinal direction L when the finger portion 101 is in the fully extended position. The distance 142 is 154 mm.

Figure 6A:
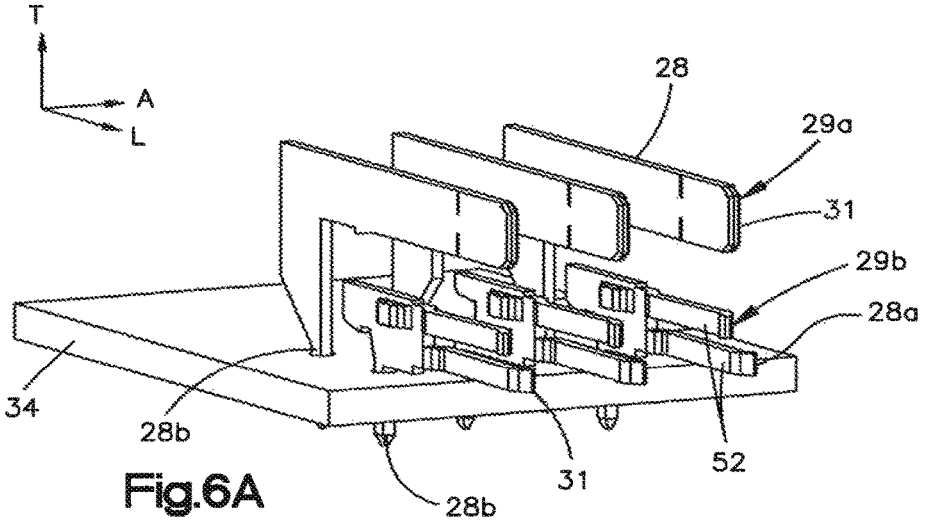
FIG. 6A is a perspective view of the first electrical connector illustrated in FIG. 5, shown with the connector housing removed.
Figure 6B:
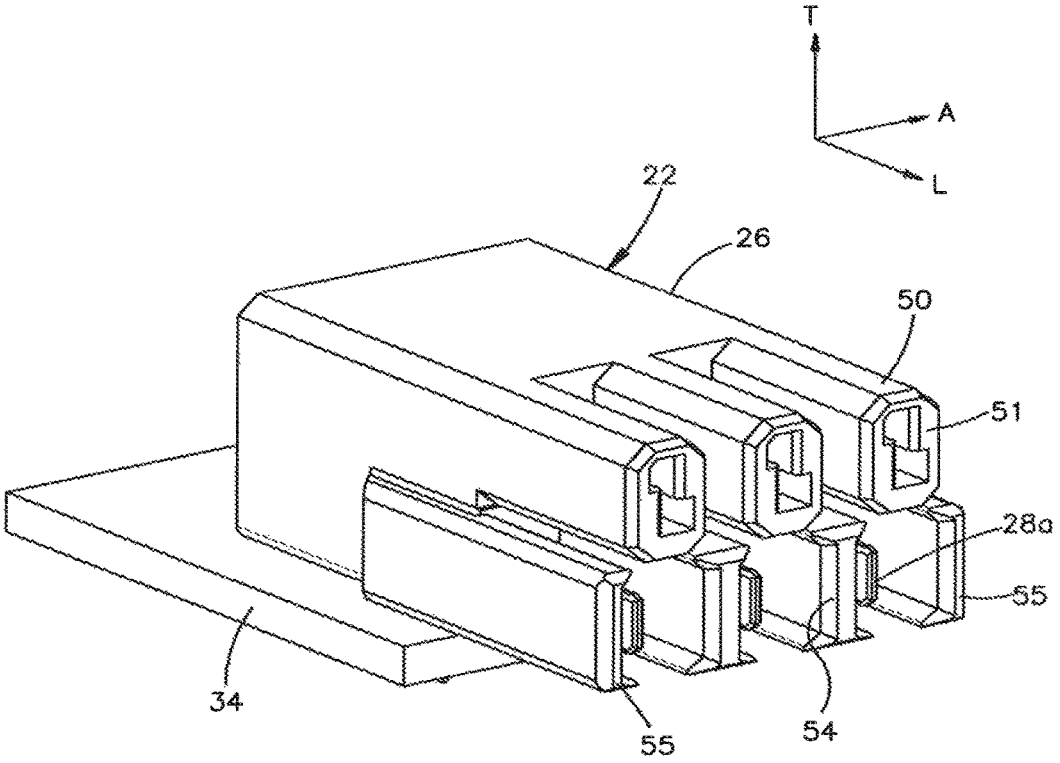
FIG. 6B is a perspective view of the second electrical connector illustrated in FIG. 5.

In accordance with one embodiment, the connector housing 26 of the first electrical connector 22 defines a plurality of shrouds 50 that at least partially, for instance fully, surround respective ones of the second plurality of electrical contacts 29*b*, which can be configured as receptacle contacts whose mating portions 28*a* include one or more fingers 52 that are configured to receive therebetween a plug contact, for instance of the second electrical connector 24. The shrouds 50 can be elongate along the mating direction. Thus, each of the shrouds 50 can fully surround the receptacle mating portions 28*a* along a plane that is defined by the lateral direction A and the transverse direction T. The shrouds 50 can extend beyond the mating portions 28*a* of the second plurality of electrical contacts 29*b* along the longitudinal direction L, such that each of the second plurality of electrical contacts 29*b* is touch proof. For instance, the plurality of shrouds 50 of the connector housing 26 can terminate at a distal end 51 along the mating direction. The second plurality of electrical contacts 29*b* can be disposed in the second row 46*b* as illustrated in FIGS. 1-3B and FIG. 6A, or can be disposed in the first row 46*a* as illustrated in FIG. 6B. At least a portion of each of the shrouds 50 can be aligned with respective ones of the first plurality of electrical contacts 29*a* along a select direction so as to render the respective ones of the first plurality of electrical contacts 29*a* touch proof with respect to the select direction. In accordance with one embodiment, the select direction can be upward along the transverse direction T as illustrated in FIGS. 1-3B, though it should be appreciated that the select direction can be downward along the transverse direction as illustrated in FIG. 6B.

Similarly, the connector housing 30 of the second electrical connector 24 defines a plurality of shrouds 50 that at least partially, for instance fully, surround respective ones of the first plurality of electrical contacts 33*a*, which can be configured as receptacle contacts whose mating portions 32*a* include one or more fingers 52 that are configured to receive therebetween a plug contact, for instance of the first electrical connector 22. Thus, each of the shrouds 50 of the second electrical connector 24 can fully surround the receptacle mating portions 32*a* along a plane that is defined by the lateral direction A and the transverse direction T. The shrouds 50 can extend beyond the mating portions 32*a* of the first plurality of electrical contacts 33*a* along the longitudinal direction L, such that each of the first plurality of electrical contacts 33*a* is touch proof. For instance, the plurality of shrouds 50 of the connector housing 30 can terminate at a distal end 51 along the mating direction. The first plurality of electrical contacts 33*a* can be disposed in the first row 48*a* as illustrated in FIGS. 1-3B, or can be disposed in the second row 48*b* as desired. At least a portion of each of the shrouds 50 can be aligned with respective ones of the second plurality of electrical contacts 33*b* along a select direction so as to render the respective ones of the second plurality of electrical contacts 33*b* touch proof with respect to the select direction. In accordance with one embodiment, the select direction can be downward along the transverse direction T as illustrated in FIGS. 1-3B, though it should be appreciated that the select direction can be upward along the transverse direction T as desired.

With continuing reference to FIGS. 1-3B, the connector housing 26 defines a plurality of beams 54 that are disposed between adjacent ones of the first plurality of electrical contacts 29*a*, and aligned with the first plurality of electrical contacts 29*a*, for instance in the lateral direction A along the first row 46*a*. Thus, the beams 54 can be spaced from each other along the lateral direction A. The beams 54 can be sized and shaped as desired, and can have a first height $H_1$ along the transverse direction T that is equal to or greater than a second height $H_2$ of the electrical contacts 28 along the transverse direction T that are adjacent the beams 54 along the lateral direction A. For instance, each beam 54 can have a body 54*a* and opposed terminal upper and lower ends 54*b* that project out with respect to the body 54*a* along the lateral direction A. Thus, the distance between adjacent terminal ends 54*b* along the lateral direction A of adjacent beams 54 is less than the distance between the bodies 54*a* of the adjacent beams along the lateral direction A. Because at least a portion of the terminal ends 54*b* is disposed out along the transverse direction with respect to the adjacent first plurality of electrical contacts 29*a*, the terminal ends 54*b*, and thus the beams 54 render the first plurality of electrical contacts 29*a* touch proof with respect to the transverse direction T, including in the downward direction. For instance, the plurality of beams 54 of the connector housing 26 can terminate at a distal end 55 along the mating direction. Thus, the plurality of beams 54 and the plurality of shrouds 50 can each terminate at a respective distal end. Each of the first plurality of electrical contacts 29*a* can terminate at a first distal end 31. Each of the first plurality of electrical contacts 29*a* can be disposed between a pair of adjacent beams 54. In accordance with an example embodiment, the distal end 55 of the beams 54 extends beyond the first distal end 31 of the first plurality of electrical contacts 29*a* along the mating direction, and the distal end 51 of the shrouds 50 extends beyond the distal end 31, which can also be referred to as the second distal end 31, of the second plurality of electrical contacts 29*b* along the mating direction.

Furthermore, the connector housing 30 defines a plurality of beams 54 that are disposed between adjacent ones of the second plurality of electrical contacts 33*b*, and aligned with the second plurality of electrical contacts 33*b*, for instance in the lateral direction A along the second row 48*b*. The beams 54 can be sized and shaped as desired, and can have a height along the transverse direction T that is equal to or greater than the height of the electrical contacts 32 along the transverse direction T that are adjacent the beams 54 along the lateral direction A. Because at least a portion of the terminal ends 54*b* is disposed out along the transverse direction with respect to the adjacent second plurality of electrical contacts 33*b*, the terminal ends 54*b*, and thus the beams 54 render the second plurality of electrical contacts 33*b* touch proof with respect to the transverse direction T, including in the downward direction. Each of the second plurality of electrical contacts 33*b* can be disposed between a pair of adjacent beams 54. In accordance with an example embodiment, the distal end 55 of the beams 54 extends beyond the second distal end 35 of the second plurality of electrical contacts 33*b* along the mating direction, and the distal end 51 of the shrouds 50 extends beyond the distal end 35 of the first plurality of electrical contacts 33*a* along the mating direction.

Accordingly, when the first and second electrical connectors 22 and 24 are mated with each other, the shrouds 50 of the each of the first and second electrical connectors 22 and 24 are received between adjacent ones of the beams 54 of the other of the first and second electrical connectors 22 and 24. Accordingly, the first portions of the mating interfaces of the first and second electrical connectors 22 and 24 can be disposed between adjacent beams 54. The second portions of the mating interfaces of the first and second electrical connectors 22 and 24 can be defined by the shrouds 50. The shrouds 50 of the first electrical connectors 22 surround the plug contacts 32 of the second electrical connector 24 when the first and second electrical connectors 22 and 24 are mated to each other. Similarly, when the first and second electrical connectors 22 and 24 are mated with each other, the shrouds 50 of the second electrical connectors 24 surround the plug contacts 28 of the first electrical connector 22. Thus, each of the shrouds 50 surrounds the portions of respective ones of the mated plug and receptacle contacts. It should be appreciated that, in accordance with an alternative embodiment, that the shrouds 50 and the beams 54 can cooperate to surround the mating portions of respective ones of the mated receptacle contacts and plug contacts when the first electrical connectors are mated to each other. It should be appreciated that each of the connector housings 26 and 30 provides protection from creepage between adjacent ones of the respective first plurality of electrical contacts along the lateral direction A along the corresponding row, between adjacent ones of the respective second plurality electrical contacts along the lateral direction A along the corresponding row, and between adjacent ones of each of the first and second pluralities of electrical contacts along the transverse direction T between the corresponding rows.

Figure 7B:
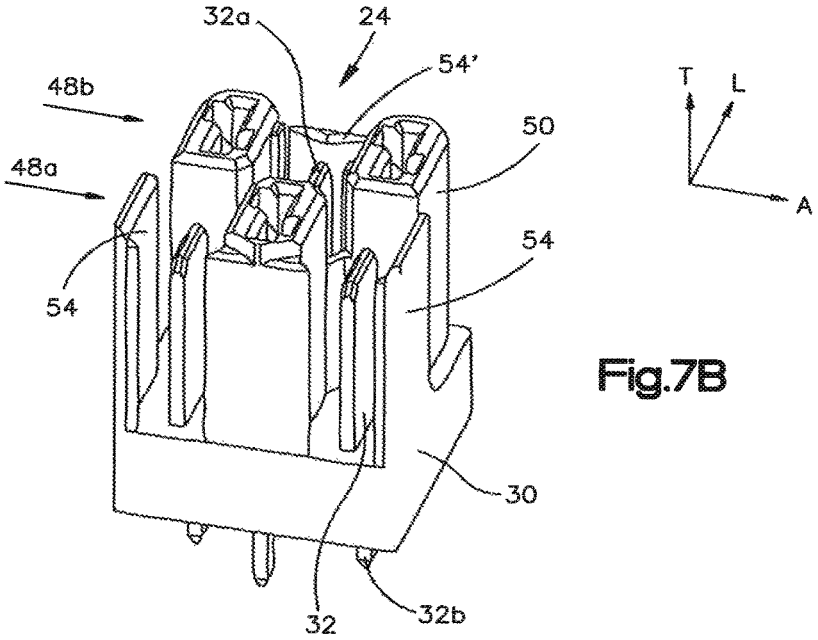
FIG. 7B is a perspective view of the second electrical connector constructed in accordance with an alternative embodiment.

Referring now to FIGS. 7A and 7B, in accordance with an alternative embodiment, the mating portions 28*a* and 32*a* that are configured as plugs can be immediately adjacent to at least one shroud 54 along the lateral direction A such that none of the mating portions configured as plugs are immediately adjacent more than one beam 54. For instance, each of the mating portions 28*a* can be immediately adjacent only one beam 54, and each of the mating portions 32*a* can be immediately adjacent only one beam 54. The mating portions 28*a* and 32*a* that are configured as plugs can be disposed between two shrouds 54 along the lateral direction A. Furthermore, the mating portion 32*a* that is disposed between two shrouds 54 along the lateral direction A can also be immediately adjacent one of the beams, for instance a beam 54' along the longitudinal direction L such that beam 54' defines a width along the lateral direction A that is substantially equal to a width along the lateral direction A of a recess 59 defined by the connector housing 26. Thus, the recess 59 can be sized to receive the beam 54' when the first electrical connector 24 is mated with the second electrical connector 24.

Figure 4:
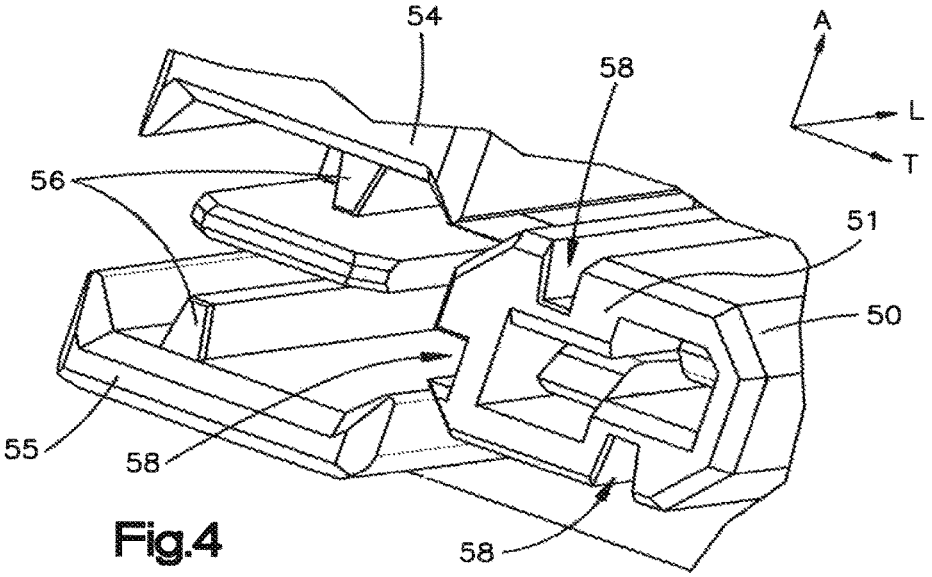
FIG. 4 is an enlarged view of a portion of the connector housings of each of the first and second electrical connectors, constructed in accordance with one embodiment.

Referring now to FIG. 4, each of the connector housings 26 and 30 can include at least one first alignment member carried by one or more up to all of the beams 54, and at least one second alignment member carried by one or more up to all of the shrouds 50. The first and second alignment members of the first and second connectors 22 and 24, respectively, are configured to engage each other so as to assist in maintaining alignment of the connector housings 26 and 30 when the first and second electrical connectors are mated. For instance, the first alignment members can be configured as ribs 56 that project from each of the beams 54 toward the respective adjacent electrical contacts. The ribs 56 can be elongate along the mating direction, which can be the longitudinal direction L, and open at the mating interface. The second alignment members can be configured as recesses 58 in respective outer surfaces of the shrouds 50, the recesses 58 sized to receive respective ones of the ribs of the other of the first and second electrical connectors 22 and 24 when the first and second electrical connectors 22 and 24 are mated to each other. The recesses 58 can thus also be elongate along the longitudinal direction L. Of course, it should be appreciated that the first engagement members can define the recesses 58 that extend into an outer surface of the beams 54, and the second engagement members can define the ribs 54 that project out from the beams toward the respective adjacent electrical contacts. Referring in particular to FIG. 4, the beams 54 and the ribs 56 can extend beyond the distal end 35 of the second plurality of electrical contacts 33*b* such that each of the second plurality of electrical contacts 33*b* is touch proof. Similarly, the beams 54 and the ribs 56 can extend beyond the distal end 31 of the second plurality of electrical contacts 29*b* such that each of the second plurality of electrical contacts 29*b* is touch proof.

Figure 9:
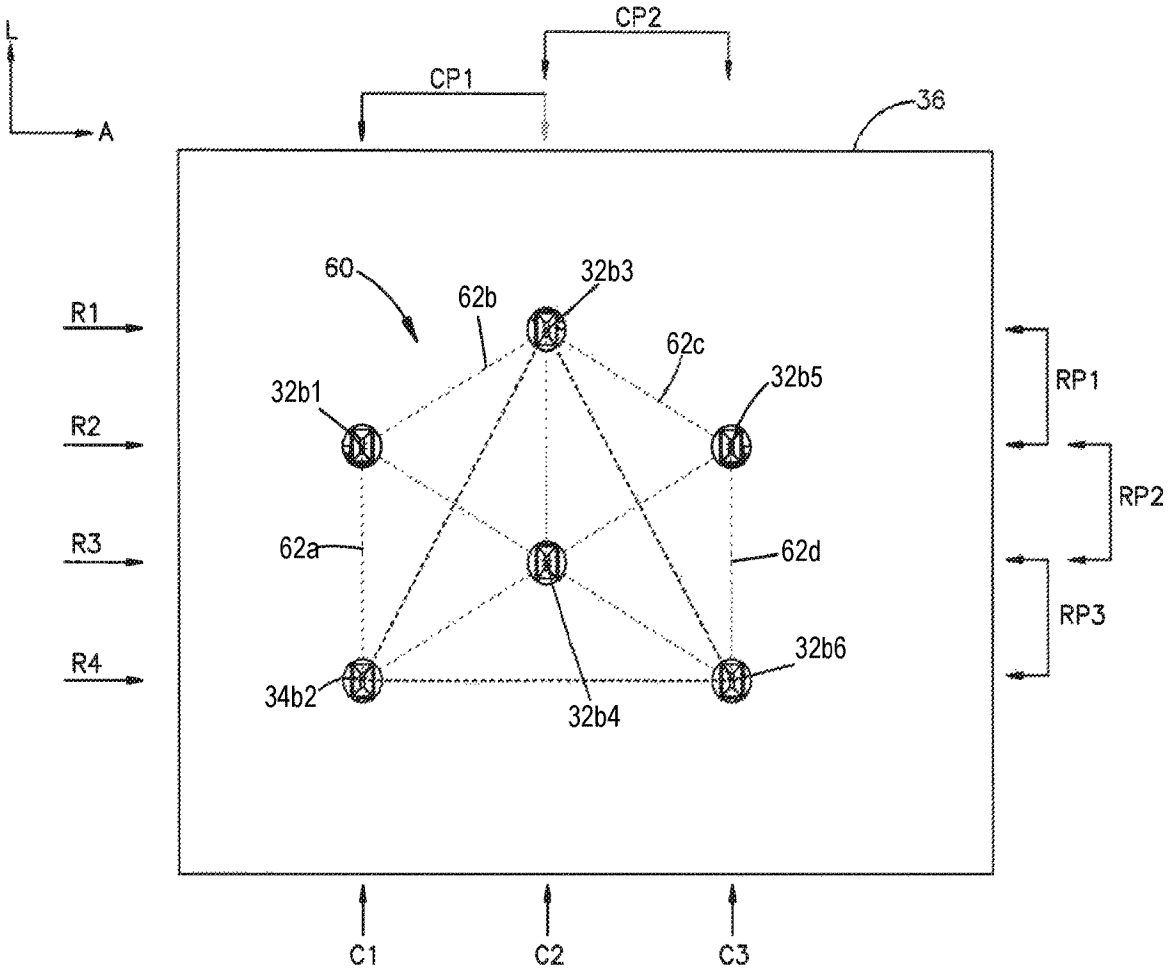
FIG. 9 is a bottom plan view of the substrate and the second electrical connector of FIG. 3A, wherein the second electrical connector is mounted to the substrate.

Referring now to FIG. 9, the mounting portions 32*b* of the electrical contacts 32 define a footprint 60 taken from a bottom plan view of the substrate 36 and the electrical connector 24 that is mounted to the substrate 36. The electrical connector 26 is illustrated as including three electrical contacts 32 that each include one mating portion 32*b*, though any number of contacts 32 and mating portions 32*b* can be included in the electrical connector as desired. While the footprint 60 is illustrated with respect to the electrical contacts 32, it will be understood that the footprint 60 can likewise be defined by the mounting portions 28*b* of the electrical contacts 28. As shown, the footprint 60 includes a plurality of columns. The mounting portions 32*b* are arranged in the plurality of columns. For instance, in accordance with the illustrated embodiment, the mounting portions 32*b* of two electrical contacts 32, for instance a first and a second mounting portion 32*b*, are arranged in a first column $C_1$. The mounting portions 32*b* of two electrical contacts 32, for instance a third and fourth mounting portion 32*b*' and 32*b*", respectively, can be arranged in a second column $C_2$. The mounting portions 32*b* of two electrical contacts 32, for instance a fourth and fifth mounting portion 32*b*, can be arranged in a third column $C_3$. The first, second, and third columns are spaced from each other along the lateral direction A. The second column $C_2$ is disposed between the first column $C_1$ and the third column $C_3$. Thus, the second column $C_2$ is adjacent to the first column $C_1$ and the third column $C_3$. The first, second, and third columns can each extend along a direction that is substantially parallel to each other. As shown, each of the first, second, and third columns extend and are elongate along the longitudinal direction L, and the plurality of columns are disposed laterally adjacent to each other.

The spacing between centerlines of adjacent columns $C_1$ and $C_2$ and adjacent columns $C_2$ and $C_3$ may be referred to as the column pitch CP. For instance, adjacent columns $C_1$ and $C_2$ can define a first column pitch CP1, and adjacent columns $C_2$ and $C_3$ can define a second column pitch CP2. As illustrated, the first column pitch CP1 between columns $C_1$ and $C_2$ can be substantially equal to the second column pitch CP2 between columns $C_2$ and $C_3$. Furthermore, in accordance with the illustrated embodiment, adjacent mounting portions 32*b* can define respective column pitches that are substantially equal to a distance that the adjacent mating portions 32*a* are spaced from each along the lateral direction A. Thus, the first and second column pitches CP1 and CP2 can be between 1 and 5 mm. In one example embodiment, the first and second column pitches defined by the mounting portions 28*b* and 32*b* are approximately 4 mm. Referring to FIGS. 7A and 7B, in accordance with another example embodiment, the first and second column pitches defined by the mounting portions 28*b* and 32*b* can be approximately 2 mm. It should be appreciated, however, that the first column pitch CP1 can alternatively be less than or greater than the second column pitch CP2 if desired. It should be further appreciated that any desired column pitch could be used as desired.

Still referring to FIG. 9, an equal number of mounting portions 32*b* can be disposed in each of the plurality of columns. For instance, two mounting portions 32*b* can be disposed in each of the plurality of columns. The mounting portions can be further arranged in a plurality of rows that are oriented substantially perpendicular to the orientation of the columns. For example, the plurality of rows can be are elongate in the lateral direction A that is substantially perpendicular to the longitudinal direction L. The rows can be longitudinally adjacent to each other. In accordance with the illustrated embodiment, one of the mounting portions 32*b* that is disposed in the second column $C_2$ is disposed in a first row $R_1$, and the other of the mounting portions 32*b* that is disposed in the second column C2 is disposed in a third row $R_3$. Furthermore, as shown, the mounting portions 32*b* that are disposed in the first column $C_1$ can be disposed in a second row $R_2$ and a fourth row $R_4$, and the mounting portions 32*b* that are disposed in the third column $C_3$ can be disposed in the second row $R_2$ and the fourth row $R_4$. The second row $R_2$ can be disposed between the first row $R_1$ and the third row $R_3$, and the third row $R_3$ can be disposed between the second row $R_2$ and the fourth row $R_4$. The spacing between adjacent rows may be referred to as the row pitch RP. For instance, the spacing between adjacent rows $R_1$ and $R_2$ can define a first row pitch RP1, the spacing between adjacent rows $R_2$ and $R_3$ can define a second row pitch RP2, and the spacing between rows $R_3$ and $R_4$ can define a third row pitch RP3. As illustrated, the first row pitch RP1 between rows $R_1$ and $R_2$ can be substantially equal to the second row pitch RP2 between rows $R_2$ and $R_3$, which can also be substantially equal to the third row pitch RP3 between rows $R_3$ and $R_4$. The rows can be spaced from each along the longitudinal direction. For instance, the rows $R_{1-4}$ can each extend along a direction that is substantially perpendicular to the direction that the columns $C_{1-3}$ extend. As shown, each of the rows extend and are elongate along the lateral direction A.

Further, as illustrated, the mounting portions 32*b* disposed in adjacent columns can be offset in the longitudinal direction L with respect to each other. For instance, the third and fourth mounting portions 32*b*' and 32*b*" in the second column $C_2$ can be offset in the longitudinal direction L with respect to the first and second mounting portions 32*b* in the first column $C_1$ and the fourth and fifth mounting portions 32*b* in the third column $C_3$. The mounting portions 32*b* disposed in the first column $C_1$ can be aligned with the mounting portions 32*b* disposed in the third column $C_3$ along the longitudinal direction L. Otherwise stated, the first and third rows $R_1$ and $R_3$ defined by the mounting portions 32*b* of one column of the electrical contacts 32 are not aligned with the second and fourth rows $R_2$ and $R_4$ defined by the mounting portions 32*b* of two other columns of the electrical contacts 32. For example, the third mounting portion 32*b*' is disposed longitudinally between the adjacent mounting portions disposed in the second row $R_2$ and the fourth row $R_4$. It is further appreciated that no mounting portions are disposed between the mounting portions 32' and 32" along the second column $C_2$. Otherwise stated, the second column $C_2$ is devoid of mounting portions that are in lateral alignment with mounting portions disposed in the first column C1 or the third column C3. Thus, as described above and in accordance with the illustrated embodiment, the mounting portions 32*b* can be arranged such that each of the mounting portions 32*b* define the vertices of at least one approximately equilateral triangle 62. The angles defined by the vertices of the triangles 62 can be approximately, for instance precisely, equal to 60 degrees. Thus, the mounting portions 32*b* can be arranged such that each of the mounting portions 32*b* define a vertex of at least one respective equilateral triangle 62 defined by three of the mounting portions 32*b*. As shown, the equilateral triangles 62 can be dependent on the row pitches being substantially equal to each other and the column pitches being substantially equal to each other. For instance, the first row pitch RP1, the second row pitch RP2, the third row pitch RP3, the first column pitch CP1, and the second column pitch CP2 can be substantially equal to each other. Further, at least one mounting portion 32*b* of one column can be disposed midway between the mounting portions 32*b* of at least one adjacent column with respect to the longitudinal direction L. In accordance with the illustrated embodiment, the mounting portions 32*b* of one column and the mounting portions 32*b* of an adjacent column define two equilateral triangles 62, though it be understood that the mounting terminals can be arranged to define any number of equilateral triangles 62 as desired.

Still referring to FIG. 9, the first and second mounting portions 32*b* can be disposed in the first column $C_1$, and the third mounting portion 32*b* can be disposed in the second column such that the first, second, and third mounting portions defining a first equilateral triangle 62. The first mounting portion 32*b*, the second mounting portion 32*b*, and the fourth mounting portion 32*b*" that is disposed in the second column $C_2$ can define a second equilateral triangle 62. The fifth and sixth mounting portions 32*b* can be disposed in the third column $C_3$ such that the fourth, fifth, and sixth mounting portions define a third equilateral triangle 62. The third mounting portion 32*b*', the fifth mounting portion 32*b*, and the sixth mounting portion 32*b* can define a fourth equilateral triangle 62. Thus, the third mounting portion 32*b*' can be a common vertex that is shared by at least four, for instance four, equilateral triangles defined by the mounting portions 32*b*.

Thus, as illustrated, the mounting portions of adjacent columns of a given electrical contact are spaced apart a greater distance than if they were not longitudinally offset (e.g., than if they were in lateral alignment). Accordingly, it can be said that a select pair of mounting portions disposed in adjacent columns are spaced apart a distance greater than the lateral distance between the adjacent columns. Conventional connectors with mounting terminals are not longitudinally offset in the manner described above. Therefore, the above-described electrical connectors provide increased spacing between the mounting portions without increasing the footprint of the mounting interface of the connector with respect to the similarly constructed connector. Otherwise stated, a conventional connector can be modified by offsetting the mounting portions along every other column such that each mounting terminal is a vertex of an equilateral triangle defined by adjacent columns, so as to increase the distance between adjacent mounting portions without increasing the footprint of the mounting interface of the electrical connector.

It should further be appreciated that the increased spacing between the mounting portions allows the electrical contacts to carry an increased working voltage (for instance 400V or greater) with respect to conventional mounting portions, while at the same time reducing or preventing voltage between mounting portions during operation. For instance, current generally follows a path of least resistance along the electrical contacts 32 to the mounting portions 32*b* and then into the printed circuit board 36. Accordingly, in conventional connectors, increased numbers of mounting portions generally allow for higher levels of current to flow through the contact. Unfortunately, increased numbers of mounting portions decreases the spacing, and thus the creepage distance, between mounting portions, which limits the working voltage. Accordingly, the electrical connectors 22 and 24 can define the footprint 60 that is configured to increase the space, and thus the creepage distance, between two immediately adjacent mounting portions, without otherwise increasing the overall footprint at the mounting interface of the connector. While the footprint 60 and its alternative embodiments have been illustrated and described with respect to the mounting portions 32*b* of one or more electrical contacts 32, for instance power contacts 32, it should be appreciated that the footprint 60 can be defined by the mounting portions of any type of contacts, for instance single-beam AC power contacts, signal contacts, or DC power contacts. While various footprint embodiments have been described in combination with the electrical connector 24, it should be appreciated that the various structures and features described herein are applicable to differently constructed connectors, for instance the electrical connectors 22, 22*a*, and 24*a* described herein.

Figure 5:
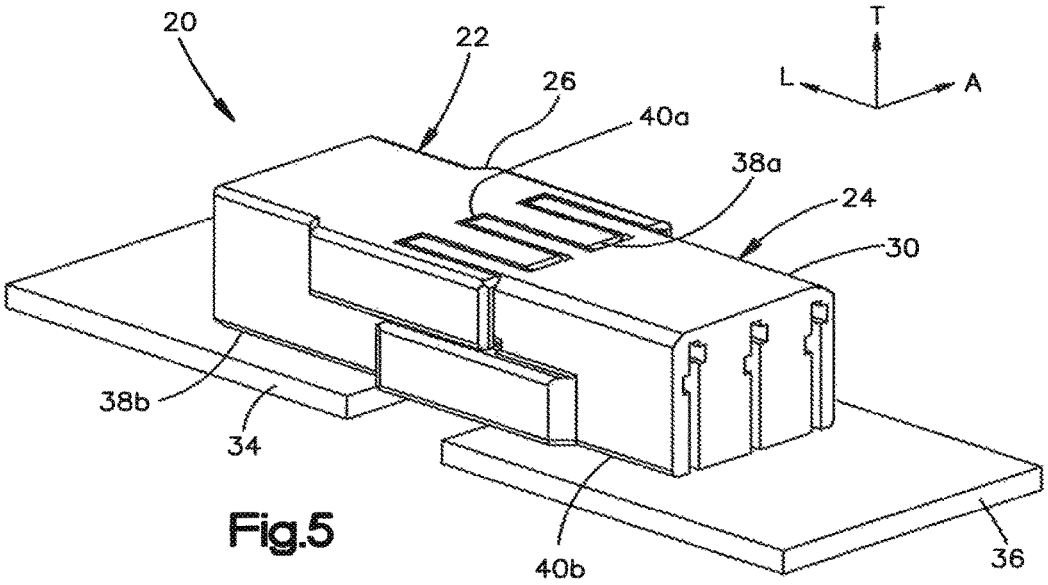
FIG. 5 is a perspective view of an electrical power connector assembly constructed in accordance with an alternative embodiment, including first and second electrical connectors configured to be mounted to respective first and second substrates.

As illustrated in FIGS. 1-3B, the first and second electrical connectors 22 and 24 can be configured such that when the first and second electrical connectors 22 and 24 are mounted to the respective first and second substrates and mated to each other, the first and second substrates are orthogonal to each other. Alternatively, as illustrated in FIGS. 5-6B, the first and second electrical connectors 22 and 24 can each be configured as right-angle electrical connectors such that when the first and second electrical connectors 22 and 24 are mounted to the respective first and second substrates and mated to each other, the first and second substrates are coplanar with each other. It should be understood that the first and second electrical connectors 22 and 24 can be configured to carry any amount of power as desired, for instance 400 V of DC power.

As described above, in accordance with an example embodiment, the first and second electrical connectors 22 and 24 are touch proof as determined by the probe 102. In particular, when the probe 102 is applied to the mating interfaces of the electrical connectors 22 and 24, the distal end 106 of the probe 102 is prevented from touching the electrical contacts 28 and 32, regardless of the angle that the probe 102 is oriented with respect to the mating interfaces of connectors 22 and 24. In particular, a portion of the finger portion 101 of the probe 102 can be disposed within the connector housings 26 and 30 during a touch proof test, but the finger portion 101 can be prevented by the housings 26 and 30, in particular the distal ends 51 of the shroud 50 and the distal end 55 of the beams 54, from being able to touch the contacts 28 and 32. Thus, during a touch proof test using the probe 102, the probe 102 and the connector housing can define a point of largest ingress. The point of largest ingress can be defined as an inward distance from the distal end 51 of the shroud 50 to the distal end 106 of the probe along the mating direction. The point of largest ingress can be less than a distance from the distal end 51 of the shroud 50 to the distal ends of the electrical contacts disposed within the shrouds 50 along the mating direction. Similarly, a point of largest ingress can be defined as an inward distance from the distal end 55 of the beams 54 to the distal end 106 of the probe along the mating direction. The point of largest ingress can be less than a distance from the distal ends 55 of the beams 54 to the distal ends of the electrical contacts disposed between the beams 54 along the mating direction.

A method can include any steps as described above. For instance, a method of mating can include the first and second electrical connectors to each other can include bringing the first and second electrical connectors toward each other. During the bringing step, the shrouds of each of the first and second electrical connectors can be inserted between adjacent ones of the beams of the other of the first and second electrical connectors. The method can further include inserting ones of the first plurality of electrical contacts of the each of the first and second electrical connectors between a pair of fingers of ones of the second plurality of electrical contacts of the other of the first and second electrical connectors so as to establish an electrical power connection between the first plurality of electrical contacts and the second plurality of electrical contacts.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. For example, while the embodiments disclosed are two tiered, it should be understood that the features may be incorporated into single tiered connectors or other multi-tiered connectors. Furthermore, it should be appreciated that structures and features described above in connection with one or more embodiments can be included in all other embodiments, unless otherwise indicated. Those skilled in the relevant art, having the benefit of the teachings of this specification, may effect numerous modifications to the invention as described herein, and changes may be made without departing from the scope and spirit of the invention as defined by the appended claims.

What is claimed:

1. An electrical power connector comprising:

an electrically insulative connector housing that includes a plurality of beams and a plurality of shrouds that each terminate at a respective distal end, the plurality of beams and the plurality of shrouds defining a mating interface configured to mate with a complementary electrical power connector along a mating direction;

a first plurality of electrical contacts supported by the connector housing, wherein at least one electrical contact of the first plurality of electrical contacts is disposed between a beam from the plurality of beams and a shroud from the plurality of shrouds; and a second plurality of electrical contacts supported by the connector housing, wherein each electrical contact of the second plurality of electrical contacts is disposed within a shroud from the plurality of shrouds, wherein the plurality of shrouds fully surround a mating portion of respective ones of the second plurality of electrical contacts, the mating portion including a distal end and configured to mate with a complementary electrical contact;

wherein the first and second plurality of electrical contacts are arranged in a first and second row that each extend along a row direction of the connector housing, wherein each row comprises at least one of the first plurality of electrical contacts and at least one of the second plurality of electrical contacts.

2. The electrical power connector of claim 1, wherein adjacent electrical contacts in the first row along the row direction define an alternating pattern of first and second electrical contacts such that no electrical contacts from the first plurality of electrical contacts are immediately adjacent to electrical contacts from the second plurality of electrical contacts along the row direction.

3. The electrical power connector of claim 1, wherein adjacent electrical contacts in the second row along the row direction define an alternating pattern of first and second electrical contacts such that no electrical contacts from the first plurality of electrical contacts are immediately adjacent to electrical contacts from the second plurality of electrical contacts along the row direction.

4. The electrical power connector of claim 1, wherein electrical contacts in the first and second rows are arranged in a plurality of columns that extend along a column direction that is perpendicular to the row direction, the columns spaced from each other along the row direction.

5. The electrical power connector of claim 4, wherein each column includes an electrical contact from the first plurality of electrical contacts and an electrical contact from the second plurality of electrical contacts.

6. The electrical power connector of claim 1, wherein each electrical contact of the first plurality of electrical contacts extends along a respective length to a mating portion, and the plurality of beams and plurality of shrouds extend beyond the mating portions of the first plurality of electrical contacts such that each of the first plurality of electrical contacts is touch proof.

7. The electrical power connector of claim 1, wherein each electrical contact of the second plurality of electrical contacts extends along a respective length to a mating portion, and the shroud within which the electrical contact is disposed extends beyond the mating portion of the electrical contact such that each of the second plurality of electrical contacts is touch proof.

8. The electrical power connector of claim 1, wherein the plurality of shrouds at least partially surround respective ones of the second plurality of electrical contacts from a plane defined by the lateral and transverse directions.

9. The electrical power connector of claim 1, wherein the dielectric connector housing further comprises ribs supported by the beams.

10. The electrical power connector of claim 9, wherein the ribs project out from the beams toward a respective one of the first plurality of electrical contacts.

11. The electrical power connector of claim 1, wherein at least one electrical contact of the first plurality of electrical contacts is disposed between two shrouds from the plurality of shrouds.

12. The electrical power connector of claim 1, wherein a row of the first and second rows comprises two electrical contacts from the first plurality of electrical contacts, each of the two electrical contacts disposed between a beam from the plurality of beams and a shroud from the plurality of shrouds.

13. The electrical power connector of claim 1, wherein:

the first row comprises an electrical contact of the first plurality of electrical contacts disposed between two shrouds from the plurality of shrouds; and the second row comprises two electrical contacts from the first plurality of electrical contacts, each of the two electrical contacts disposed between a beam from the plurality of beams and a shroud from the plurality of shrouds.

14. The electrical power connector of claim 1, wherein a beam of the plurality of beams is disposed at a side of the connector housing, such that the side of the connector housing and an outer-side of the beam form an L-shape configured to accept a corresponding L-shape in the complementary electrical power connector along the mating direction.

15. An electrical power connector comprising:

an electrically insulative connector housing that includes a plurality of beams and a plurality of shrouds that each terminate at a respective distal end, the plurality of beams and the plurality of shrouds defining a mating interface configured to mate with a complementary electrical power connector along a mating direction;

a first plurality of electrical contacts supported by the connector housing, wherein at least one electrical contact of the first plurality of electrical contacts is:

disposed between a beam from the plurality of beams and a shroud from the plurality of shrouds; and spaced from the beam and the shroud; and a second plurality of electrical contacts supported by the connector housing, wherein each electrical contact of the second plurality of electrical contacts is disposed within a shroud from the plurality of shrouds;

wherein the first and second plurality of electrical contacts are arranged in a first and second row that each extend along a row direction of the connector housing, wherein each row comprises at least one of the first plurality of electrical contacts and at least one of the second plurality of electrical contacts.

16. The electrical power connector assembly of claim 15, wherein adjacent electrical contacts of the electrical power connector in the first row along the row direction define an alternating pattern of first and second electrical contacts such that no electrical contacts from the first plurality of electrical contacts are immediately adjacent to electrical contacts from the second plurality of electrical contacts along the row direction.

17. The electrical power connector assembly of claim 15, wherein adjacent electrical contacts of the electrical power connector in the second row along the row direction define an alternating pattern of first and second electrical contacts such that no electrical contacts from the first plurality of electrical contacts are immediately adjacent to electrical contacts from the second plurality of electrical contacts along the row direction.

18. The electrical power connector assembly of claim 15, wherein:

the complementary electrical connector comprises:

a second electrically insulative connector housing that includes a second plurality of beams and a second plurality of shrouds that each terminate at a second respective distal end, the second plurality of beams and the second plurality of shrouds defining a second mating interface configured to mate with the electrical power connector; and a third and fourth plurality of electrical contacts supported by the second connector housing, wherein the third plurality of electrical contacts are configured to mate with the first plurality of electrical contacts, and wherein the fourth plurality of electrical contacts are configured to mate with the second plurality of electrical contacts; and a beam of the plurality of beams of the electrical power connector is disposed at a side of the connector housing, such that the side of the connector housing and an outer-side of the beam form an L-shape configured to accept a corresponding L-shape in the complementary electrical power connector along the mating direction.

19. The electrical power connector assembly of claim 18, wherein a second beam of the second plurality of beams of the complementary electrical power connector is disposed at a side of the second connector housing, such that the side of the second connector housing and an outer-side of the second beam form the corresponding L-shape in the complementary electrical power connector.

20. An electrical power connector comprising:

an electrically insulative connector housing that includes a plurality of beams and a plurality of shrouds that each terminate at a respective distal end, the plurality of beams and the plurality of shrouds defining a mating interface configured to mate with a complementary electrical power connector along a mating direction;

a first plurality of electrical contacts supported by the connector housing, wherein at least one electrical contact of the first plurality of electrical contacts is disposed between a beam from the plurality of beams and a shroud from the plurality of shrouds; and a second plurality of electrical contacts supported by the connector housing, wherein each electrical contact of the second plurality of electrical contacts is disposed within a shroud from the plurality of shrouds;

wherein the first and second plurality of electrical contacts are arranged in a first and second row that each extend along a row direction of the connector housing, wherein:

each row comprises at least one of the first plurality of electrical contacts and at least one of the second plurality of electrical contacts; and a row of the first and second rows comprises two electrical contacts from the first plurality of electrical contacts, each of the two electrical contacts disposed between a beam from the plurality of beams and a shroud from the plurality of shrouds.

* * * * *